US007740022B2

(12) United States Patent
Li

(10) Patent No.: US 7,740,022 B2
(45) Date of Patent: Jun. 22, 2010

(54) OUTDOOR CANOPY

(76) Inventor: Wanda Ying Li, 3000 S. Croddy Way, Santa Ana, CA (US) 92704

( * ) Notice: Subject to any disclaimer, the term of this patent is extended or adjusted under 35 U.S.C. 154(b) by 0 days.

(21) Appl. No.: 11/636,793

(22) Filed: Dec. 8, 2006

(65) Prior Publication Data

US 2007/0079855 A1 Apr. 12, 2007

Related U.S. Application Data

(63) Continuation-in-part of application No. 11/583,247, filed on Oct. 18, 2006.

(51) Int. Cl.
*E04H 15/00* (2006.01)

(52) U.S. Cl. ..... 135/87; 135/93; 135/117

(58) Field of Classification Search ..... 135/33.7, 135/84, 88.13, 88.15, 91, 94, 117, 119, 122, 135/156, 160, 87, 93
See application file for complete search history.

(56) References Cited

U.S. PATENT DOCUMENTS

| | | | | | |
|---|---|---|---|---|---|
| 39,416 | A * | 8/1863 | Moakley | 135/94 |
| 590,706 | A * | 9/1897 | Lentz et al. | 160/54 |
| 1,531,622 | A * | 3/1925 | Parsons | 135/93 |
| 1,576,942 | A * | 3/1926 | Beebe | 135/100 |
| 1,828,656 | A * | 10/1931 | Handler | 135/149 |
| 1,856,658 | A * | 5/1932 | Rummler | 135/93 |
| 2,069,479 | A * | 2/1937 | Pluth | 135/115 |
| 3,534,750 | A * | 10/1970 | Kolozsvary | 135/132 |
| 4,231,289 | A * | 11/1980 | Domicent | 454/52 |
| 4,265,261 | A * | 5/1981 | Barker | 135/100 |
| 4,793,371 | A * | 12/1988 | O'Ferrell et al. | 135/160 |
| D343,688 | S * | 1/1994 | Jason | D25/16 |
| D353,678 | S * | 12/1994 | Diaz | D25/16 |
| 6,021,796 | A * | 2/2000 | Vavra | 135/147 |
| 6,170,503 | B1 * | 1/2001 | Lin Shy | 135/119 |
| 6,192,909 | B1 * | 2/2001 | Strausser | 135/137 |
| 6,263,895 | B1 * | 7/2001 | Bang | 135/138 |
| 6,499,497 | B1 * | 12/2002 | Swetish et al. | 135/115 |
| 6,662,816 | B1 * | 12/2003 | Cunningham | 135/94 |
| 6,679,277 | B2 * | 1/2004 | Choi | 135/93 |
| 6,701,948 | B2 * | 3/2004 | Jopp et al. | 135/97 |
| 6,994,099 | B2 * | 2/2006 | Goldwitz | 135/122 |
| 2006/0042673 | A1 * | 3/2006 | Tseng | 135/117 |
| 2007/0039247 | A1 * | 2/2007 | Greenfeld et al. | 52/2.25 |
| 2007/0094947 | A1 * | 5/2007 | Greenfeld et al. | 52/79.1 |

* cited by examiner

*Primary Examiner*—David Dunn
*Assistant Examiner*—Noah Chandler Hawk
(74) *Attorney, Agent, or Firm*—Raymond Y. Chan; David and Raymond Patent Firm

(57) ABSTRACT

An outdoor canopy includes a canopy frame, a canopy shelter and a side entrance arrangement. The canopy frame includes a roof frame and a legs frame downwardly extended from the roof frame to form a canopy area. The canopy shelter, which is made of waterproof fabric, is detachably fastening at the canopy frame to define a ceiling wall, a front wall, a rear wall and two sidewalls for enclosing the canopy area therewithin. The side entrance arrangement is formed on one of the sidewalls of the canopy shelter for a user to gain entry to and exit the canopy area without having to pass through the front entrance, wherein the side entrance arrangement contains a side entrance opening formed on the corresponding sidewall of the canopy shelter, and comprise at least one entrance fabric operatively mounted on the corresponding sidewall.

6 Claims, 21 Drawing Sheets

OUTDOOR CANOPY

CROSS REFERENCE OF RELATED APPLICATION

This application is a continuation-in-part of a utility application having an application Ser. No. 11/583,247, and a filing date of 18 Oct. 2006.

BACKGROUND OF THE PRESENT INVENTION

1. Field of Invention

The present invention relates to a canopy, and more particularly to a canopy for a vehicle which comprises a ventilation arrangement which is capable of providing effective ventilation within the canopy, and is easy to install for convenient outdoor use.

2. Description of Related Arts

A canopy for a vehicle provides users with a specific place to avoid direct exposure from strong sunshine, such as in villas, beaches, hotels, apartments etc. Although more and more functions and shapes are being designed by inventor on canopies, there exist several disadvantages for conventional canopies. First, the function of the wind-proof arrangement in conventional canopies is not good. Especially when we use the canopy in windy days, the fabric could easily be rolled up. Second, because the height of the canopy can not be adjusted, it is not convenient for people to use. Third, most conventional canopies do not have an independent lighting system so that people may not conduct social activities in the canopies during night time or in a dark environment.

There are other problems. As a matter of fact, most conventional canopies are difficult to assemble and disassemble. This may due to the fact that most conventional canopies are designed for use in outdoor environment, where strong wind and adverse weather condition may be prevalent. Thus, the physical structure of most conventional canopies may be designed in such a manner that it could resist strong wind and adverse weather condition. Very often, this means that an inflexible mounting mechanism is employed. In other words, give the nature of outdoor canopies, one may wish to have an outdoor which is easy to assemble and disassemble (i.e. easy to transport and install). On the other hand, however, since the canopies are to be used in outdoor environment, one also wishes them to possess adequate ability to resist strong wind and other adverse weather conditions.

Furthermore, for most conventional canopies, they may have certain windows formed thereon for ventilation. For example, a conventional canopy may comprise a supporting frame, a shading fabric supported by the supporting frame to define a front fabric panel, a rear fabric panel, and two inclined side fabric panels, wherein the windows are formed on the two side fabric panels for communicating the area on which the shading fabric is covered, and an exterior of the canopy. The problem with this feature is that while windows may provide ventilation for the canopy, they do so by sacrificing the privacy of the people staying within the canopy. More specifically, conventional canopies do not usually have some sorts shading for allowing the users to selectively cover up the window so that they will find that the provision of windows may actually bring inconvenience to them.

Moreover, for conventional car canopies, there exists a problem that there are inadequate canopy doors for users. For example, a typical car canopy usually has a main door opening formed on a front side thereof for a vehicle to pass therethrough. Very often, however, the users will find that it is very difficult for them to reach the door of the vehicle through the main door opening because when a vehicle has parked within the canopy, there may have very little space left for the users.

SUMMARY OF THE PRESENT INVENTION

A main object of the present invention is to provide an outdoor canopy for a vehicle which comprises a ventilation arrangement which is capable of providing effective ventilation within the canopy, and is easy to install for convenient outdoor use.

Another object of the present invention is to provide an outdoor canopy comprising a ventilation arrangement which is capable of selectively providing effective ventilation while ensuring that the users' privacy is not thereby compromised.

Another object of the present invention is to provide an outdoor canopy which comprises a plurality of adjustable supporting legs for optimally standing on an uneven ground surface. In other words, the present invention is optimal for use in outdoor environment where the ground on which the outdoor canopy stands is usually uneven.

Another object of the present invention is to provide an outdoor canopy which mainly utilizes detachable connection between a canopy frame and the canopy fabric so as to minimize the time of assembling and disassembling of the present invention. Since the mechanical components of the outdoor canopy can be easily attached and detached, the outdoor canopy can therefore be easily transported and carried.

Another object of the present invention is to provide an outdoor canopy which does not involve complicated or expensive mechanical components so as to minimize the manufacturing of the present invention.

Accordingly, in order to accomplish the above objects, the present invention provides an outdoor canopy, comprising:

a canopy frame which comprises a roof frame and a legs frame downwardly extended from the roof frame to form a canopy area within the roof frame and the legs frame, wherein the legs frame comprises a plurality of length-adjustable supporting legs spacedly and downwardly extended from the roof frame to self-adjust a height of the roof frame with respect to an uneven ground surface;

a canopy shelter, which is made of waterproof fabric, detachably fastening at the canopy frame to define a ceiling wall, a front wall, a rear wall and two sidewalls for enclosing the canopy area therewithin, wherein the canopy shelter has a front entrance formed at the front wall for communicating with the canopy, and a ventilation arrangement comprising at least a side window for enhance an air ventilation of the canopy shelter, wherein the side window comprises a window screen formed at one of the sidewalls of the canopy fabric for allowing air circulation within the canopy area and a window blind overlappingly mounted on the respective sidewall in a foldable manner to selectively enclose the window screen, such that window blind is folded to enclose the window screen for preventing dust and rain entering into the canopy area and is folded to expose the window screen for allowing air circulating within the canopy area.

These and other objectives, features, and advantages of the present invention will become apparent from the following detailed description, the accompanying drawings, and the appended claims.

DETAILED DESCRIPTION OF THE PREFERRED EMBODIMENT

Figure 1:
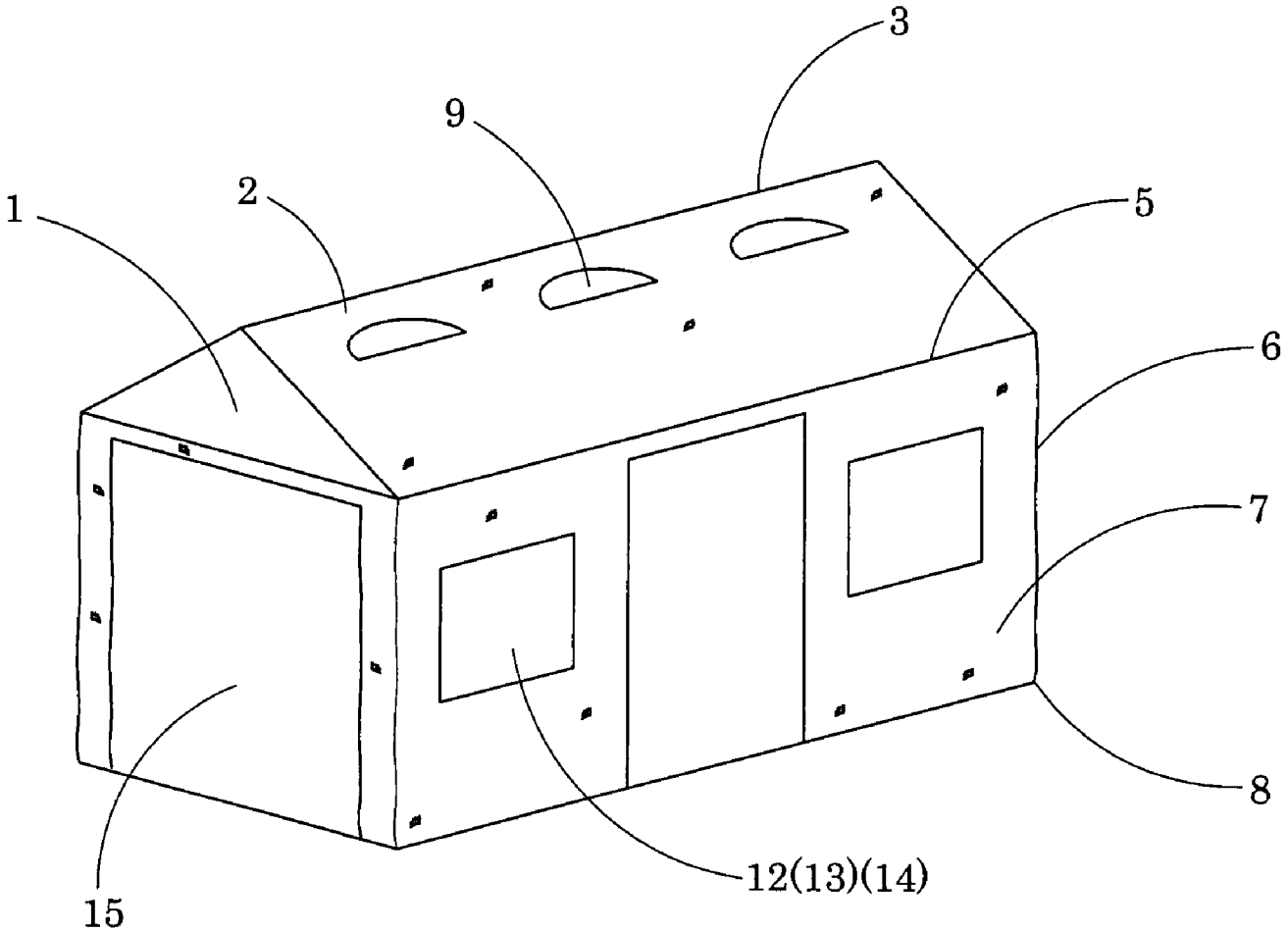
FIG. 1 is a schematic view of a canopy according to a preferred embodiment of the present invention.

Referring to FIG. 1 of the drawings, a canopy, such as an outdoor canopy, according to a preferred embodiment of the present invention is illustrated, in which the canopy comprises a first fabric panel 1 and a second fabric panel 1, a top canopy 2, a roof frame 3, a side wall 4, a horizontal bar 5, a legs frame 6, a side fabric panel 7, and a mounted plate 8.

A first fabric panel 1 means the front side fabric panel of the canopy, and a second fabric panel 1 means the back side fabric panel of the canopy.

A roof frame 3 is provided on top of the legs frame, wherein the roof frame 3 comprises a horizontal bar 305 and a plurality of inclined bars 302 spacedly, inclinedly and downwardly extended from the horizontal bar to connect with the legs frame 6.

A legs frame 6 which comprises a plurality of adjustable supporting legs 61 spacedly and upwardly extended from a ground surface to define a canopy area within the supporting legs 61, wherein a height of each of the supporting legs 61 is optimally adjustable for allowing the legs frame to securely rest on an uneven ground surface.

Figure 2:
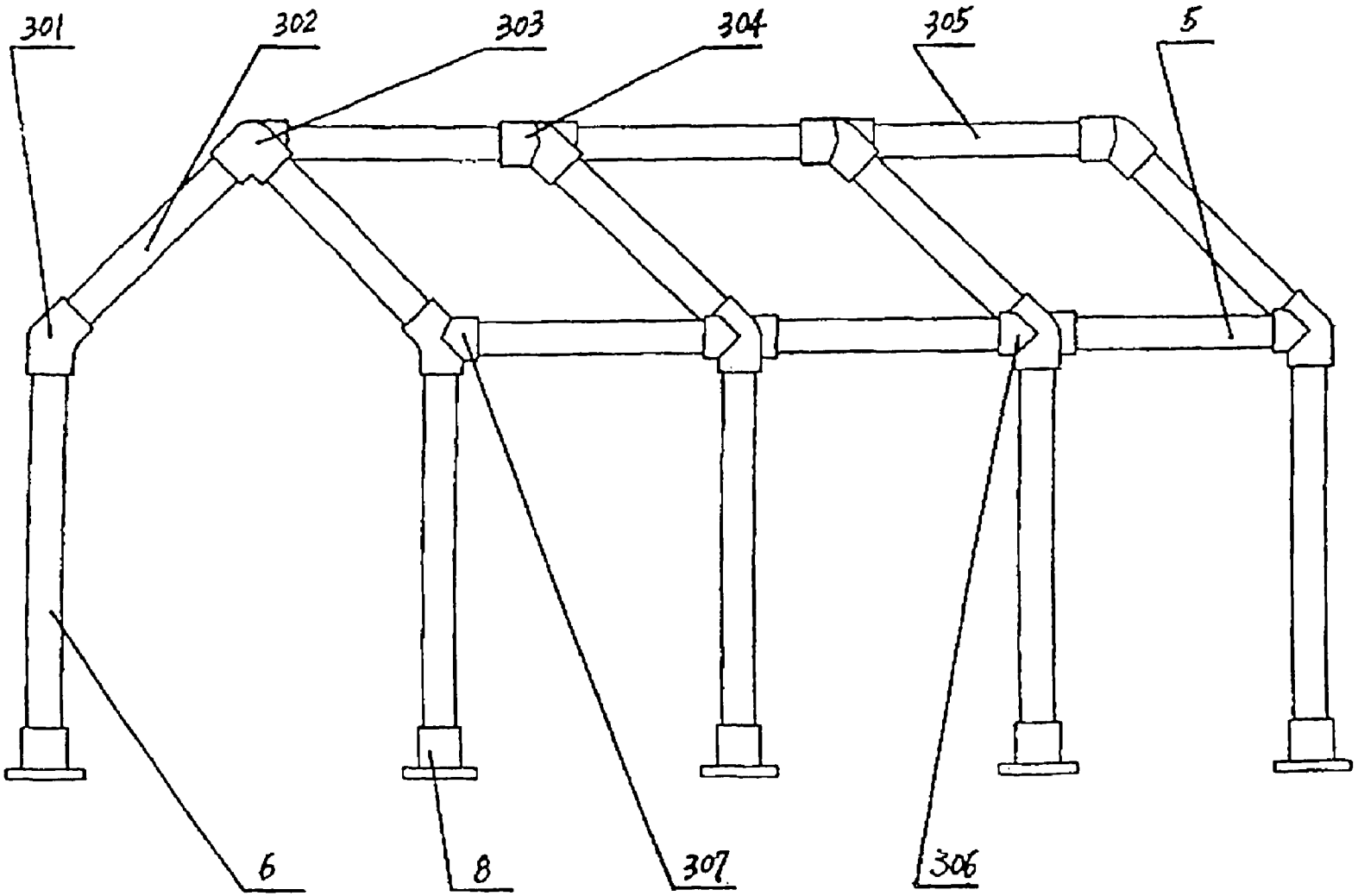
FIG. 2 is a perspective view of the canopy according to the above preferred embodiment of the present invention, illustrating a front side of the canopy.

Referring to FIG. 2 of the drawings, a roof frame according to a preferred embodiment of the present invention is illustrated, in which the roof frame comprises a three-way connector 301, a incline bar 302, a three-way connector 303, a four-way post connector 304, a horizontal bar 305, a four-way a post connector 306, and a three-way connector 307. When fabricating the frame, a user is required to put the incline bar 302, the horizontal bar 305 into the three-way connector or the four-way connector correspondingly. Similarly, a horizontal bar 5 and a base frame 6 is also put into the three-way connector or the four-way connectors correspondingly to form the frame as shown in FIG. 2.

A canopy fabric structure comprises a top canopy 2 supported by the roof frame 3 to shade an area thereunder, and a leg fabric supported by the legs frame to surround the canopy area within the supporting legs 61, wherein the leg fabric has a front fabric panel, a back fabric panel, and two side fabric panels supported by the legs frame for encircling thereof so as to normally conceal the canopy area within the legs frame.

A ventilation arrangement is provided on the canopy fabric structure for allowing ventilation in the canopy area, wherein the ventilation arrangement comprises at least a ventilating skylight formed on the canopy fabric structure in such a manner that the ventilating skylight is arranged to selectively allow air passing therethough for effectively ventilating the canopy area via the ventilating skylight 9.

A front fabric panel 1, a back fabric panel 1, a top canopy 2, and a long side panel with door 7 can combine together through sewing, zipper, or Velcro to interlink and incorporate with the frame.

Figure 3:
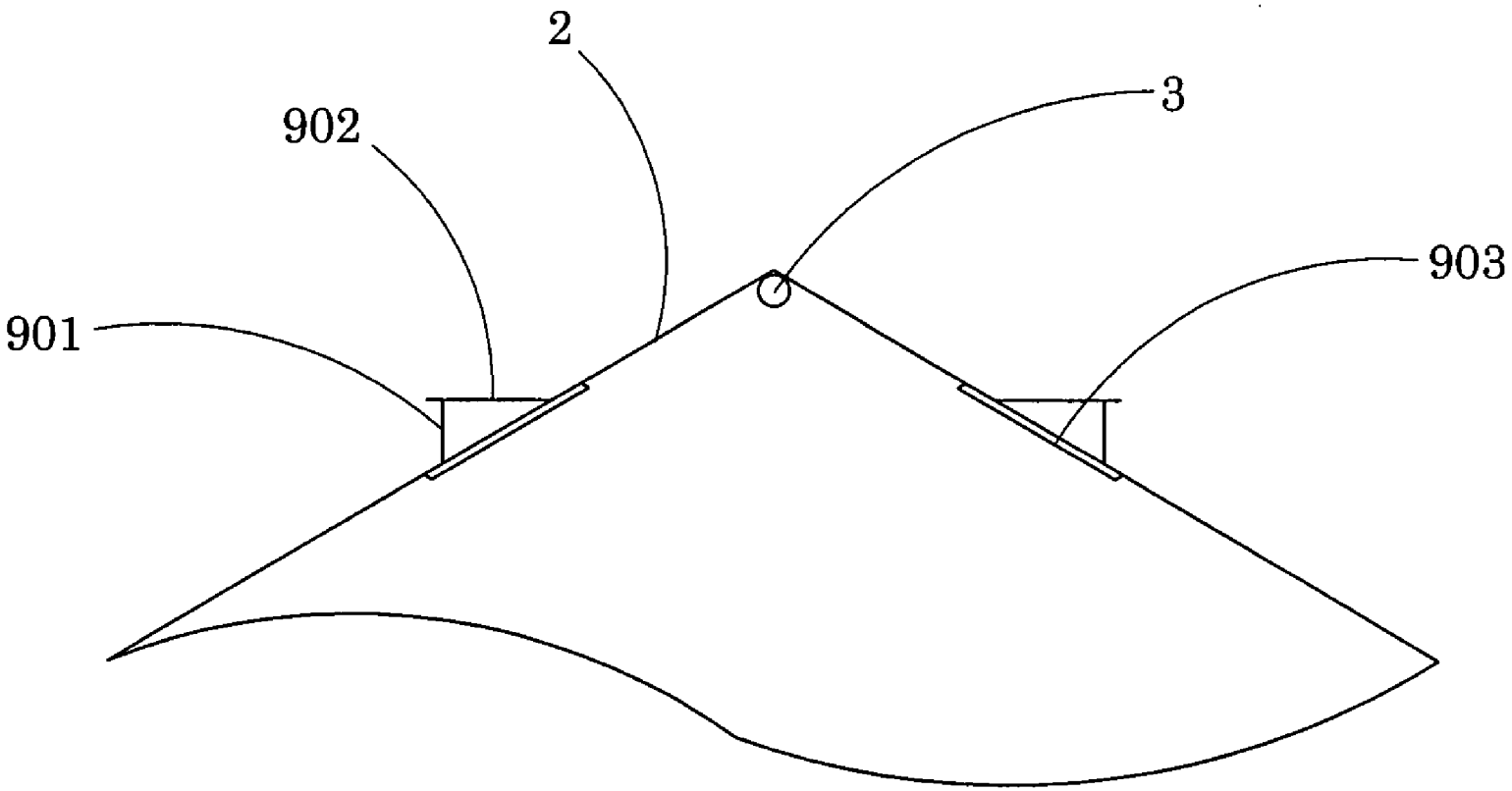
FIG. 3 is a perspective view of the skylight on the ceiling of the canopy according to the above preferred embodiment of the present invention.
Figure 4:
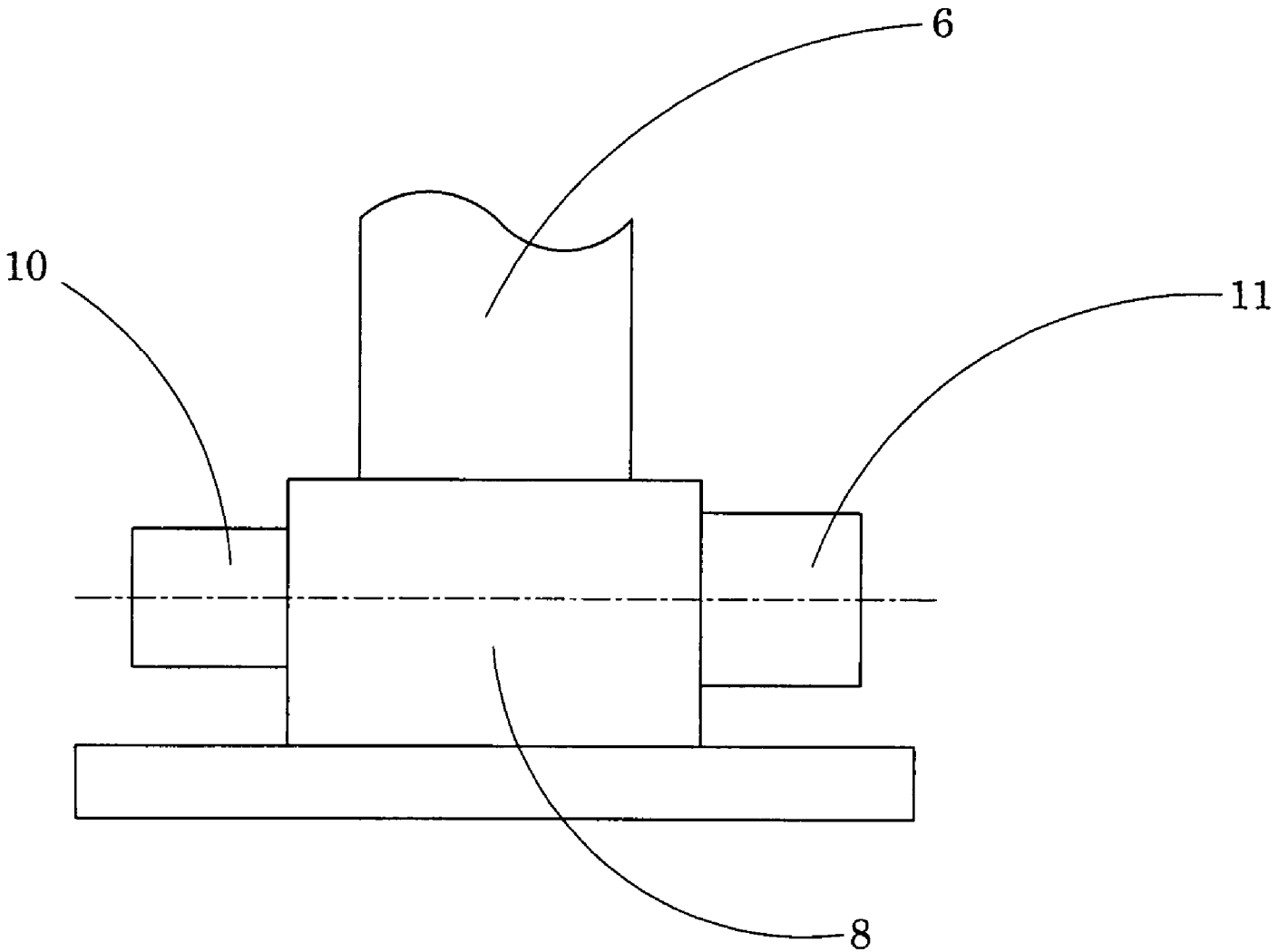
FIG. 4 is a side view of the canopy according to the above preferred embodiment of the present invention, illustrating the joints between base frame and panel with a door.
Figure 5:
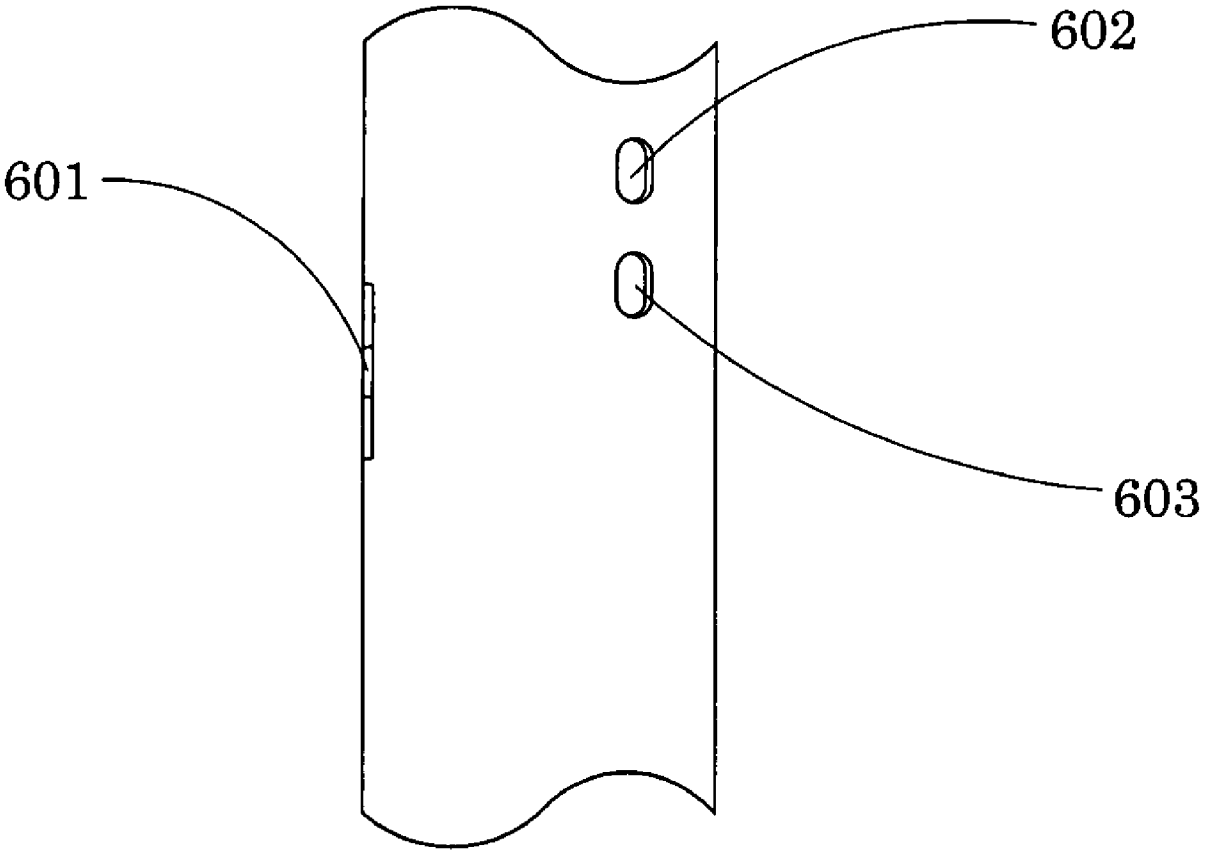
FIG. 5 is a front view of the canopy according to the above preferred embodiment of the present invention, illustrating the joints on the base frame.
Figure 6:
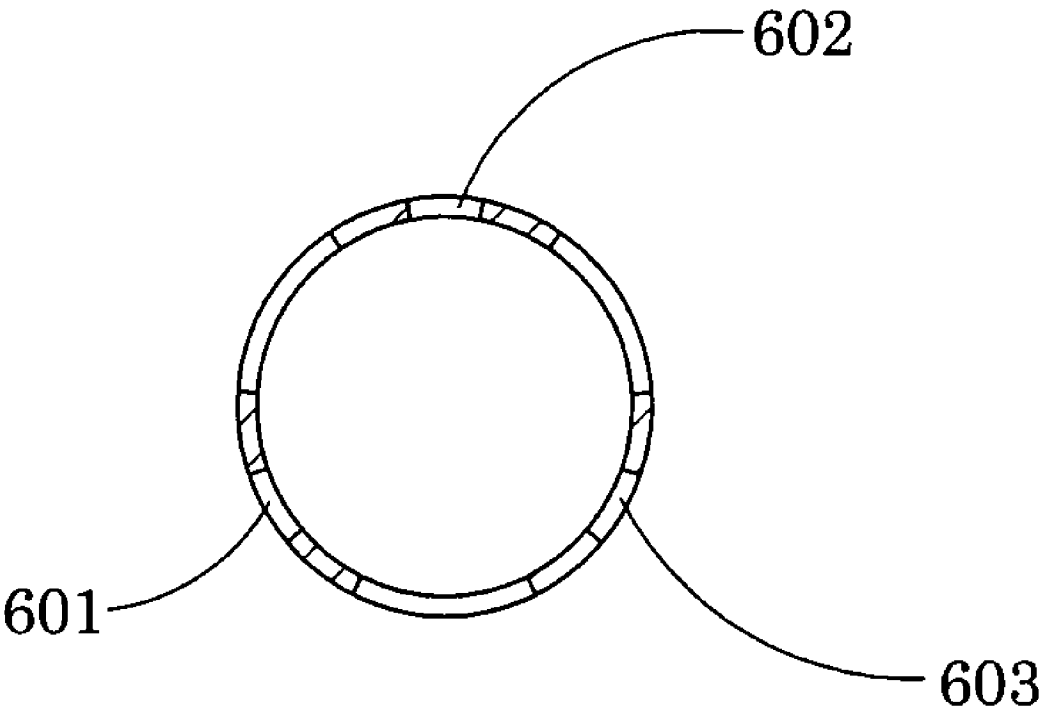
FIG. 6 is a sectional view of the canopy according to the above preferred embodiment of the present invention, illustrating the joints of the base frame

A top canopy 2 comprises the ceiling skylight, which is easy for people to assembling and disassembling comprises a supporting members 901, a canvas fabric 902, and a sheer curtain 903 as shown in FIG. 3 for making the indoor area quite airy.

The opening of the top canopy 2 is sewed by the sheer curtain 903 for airy the indoor area, preventing mosquito form going into the canvas, and increasing the intensity of the canvas. The supporting members 901 are used for adapting the size of the window.

The mounted plate 8 mounted under the base frame, and there is a gauge hole. There are a screw bolt 10, and a screw nut 11, which can pass through three oval position holes 601, 602, 603 on the base frame 6 respectively wherein the four base points could be adjusted for different ground levels.

A side fabric panel 7 according to a preferred embodiment of the present invention is illustrated, in which a side fabric panel 7 comprises a side door 4 and a window 14 which is sewed on the side fabric panel 7.

The PVC fabric 12 or a sheer curtain 13 is stitched on the side fabric panel with the window 7, and the window 14 which could be rolled up is outside the PVC fabric 12 or a sheer curtain 13.

You can fold the fabric to the right and velcro it, fold the fabric towards the top and velcro to attach, or roll the fabric to the side.

The side door 4 which could be rolled up is mounted on the side fabric panel 7 by zipper. In the same way, the door 15 is mounted on the front and back panel 1 by zipper, too.

Figure 7:
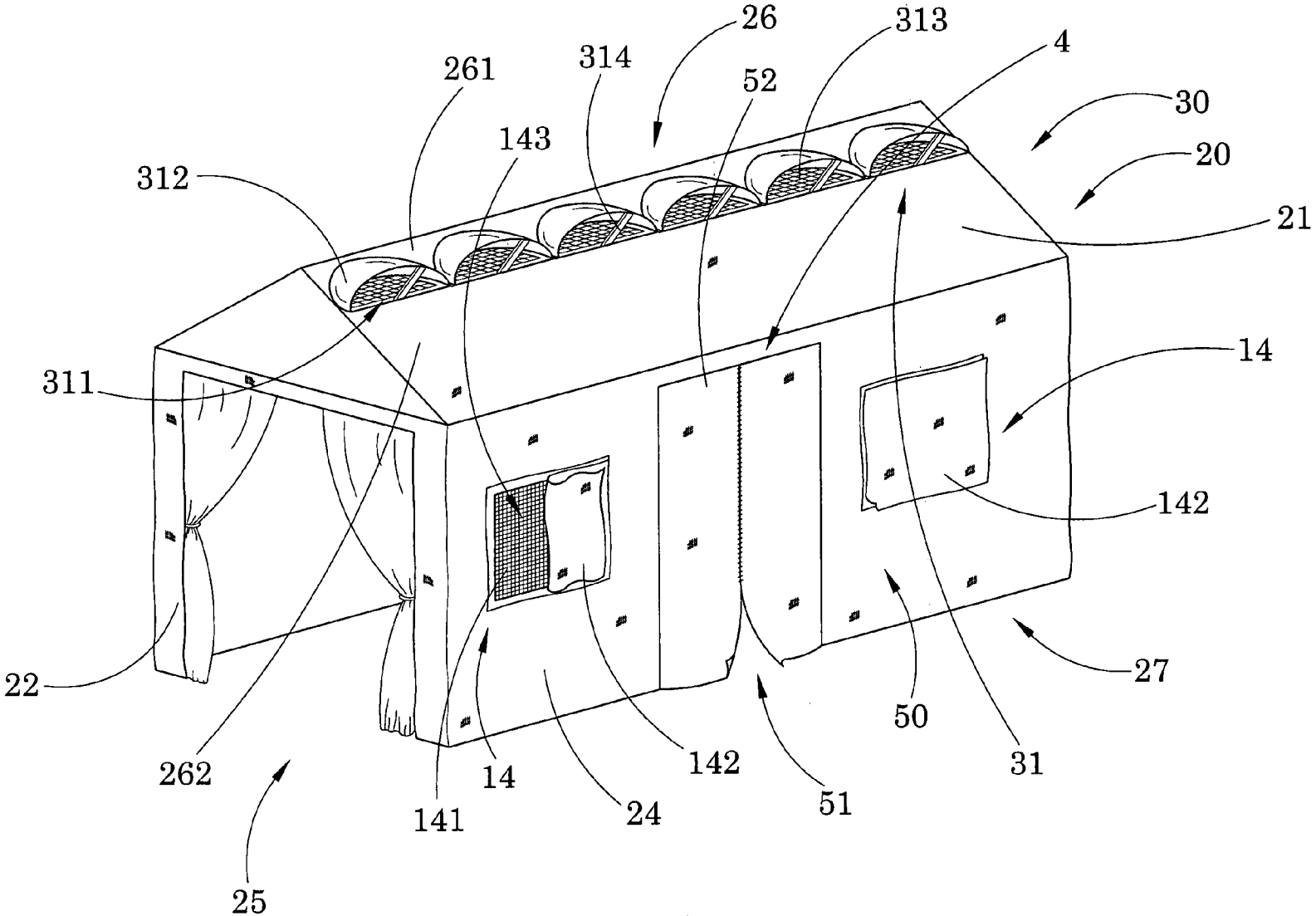
FIG. 7 is a perspective view of an outdoor canopy according to a preferred embodiment of the present invention.
Figure 8:
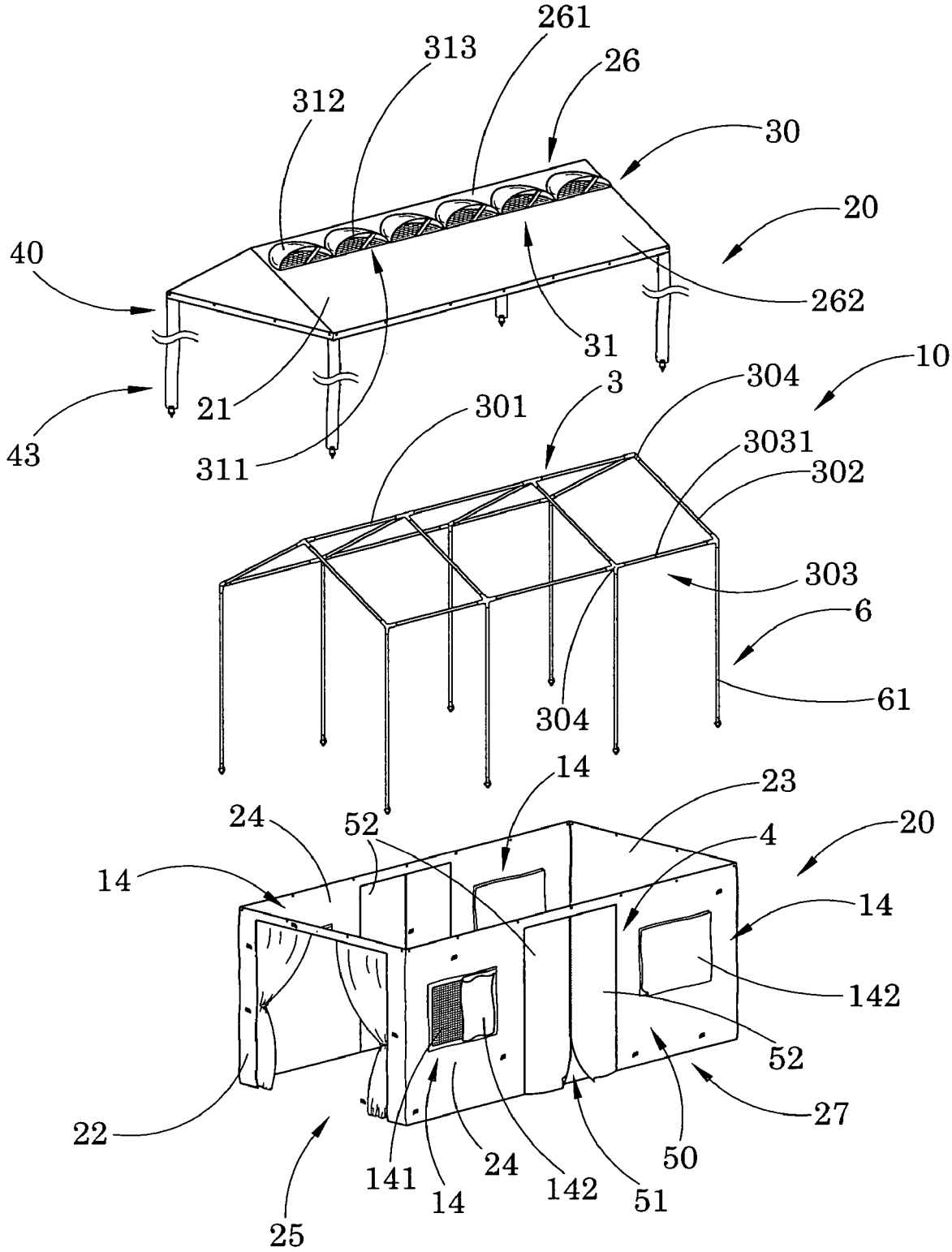
FIG. 8 is an exploded perspective view of the outdoor canopy according to the above preferred embodiment of the present invention.

To describe the present invention in a more specific manner, referring to FIG. 7 to FIG. 8 of the drawings, an outdoor canopy according to a preferred embodiment of the present invention is illustrated, in which the outdoor canopy comprises a canopy frame 10, a canopy shelter 20, and a ventilation arrangement 30.

The canopy frame 10 comprises the roof frame 3 and a legs frame 6 downwardly extended from the roof frame 3 to form a canopy area within the roof frame 3 and the legs frame 6, wherein the legs frame 6 comprises a plurality of length-adjustable supporting legs 61 spacedly and downwardly extended from the roof frame 3 to self-adjust a height of the roof frame 3 with respect to an uneven ground surface.

The canopy shelter 20, which is made of waterproof fabric, detachably fastening at the canopy frame 10 to define a ceiling wall 21, a front wall 22, a rear wall 23 and two sidewalls 24 for enclosing the canopy area therewithin, wherein the canopy shelter 20 has a front entrance 25 formed at the front wall 22 for communicating with the canopy.

The ventilation arrangement 30 comprises at least a side window 14 for enhancing an air ventilation of the canopy shelter 20, wherein the side window 14 comprises a window screen 141 formed at one of the sidewalls 24 of the canopy shelter 20 for allowing air circulation within the canopy area, and a window blind 142 overlappingly mounted on the respective sidewall 24 in a foldable manner to selectively enclose the window screen 141, such that window blind 142 is folded to enclose the window screen 141 for preventing dust and rain entering into the canopy area and is folded to expose the window screen 141 for allowing air circulating within the canopy area.

According to the preferred embodiment of the present invention, the roof frame 3 comprises a roof supporting member 301 such as the above-mentioned horizontal bar, a roof reinforcing frame 303, and a plurality of shelter supporting members 302, such as the above mentioned inclined bars, downwardly and spacedly extended from the roof supporting member 301 to connect with the roof reinforcing frame 303 to form the canopy area within the roof frame 3 and the legs frame 6. Accordingly, the roof reinforcing frame 303 comprises a plurality of reinforcing members 3031 each of which is suspendedly mounted with two adjacent reinforcing members 3031 in an end-to-end manner for forming a roof boundary of the roof frame 3, wherein legs frame 6 is extended underneath the roof boundary for standing on a ground surface, possibly on an uneven ground surface.

Figure 10A:
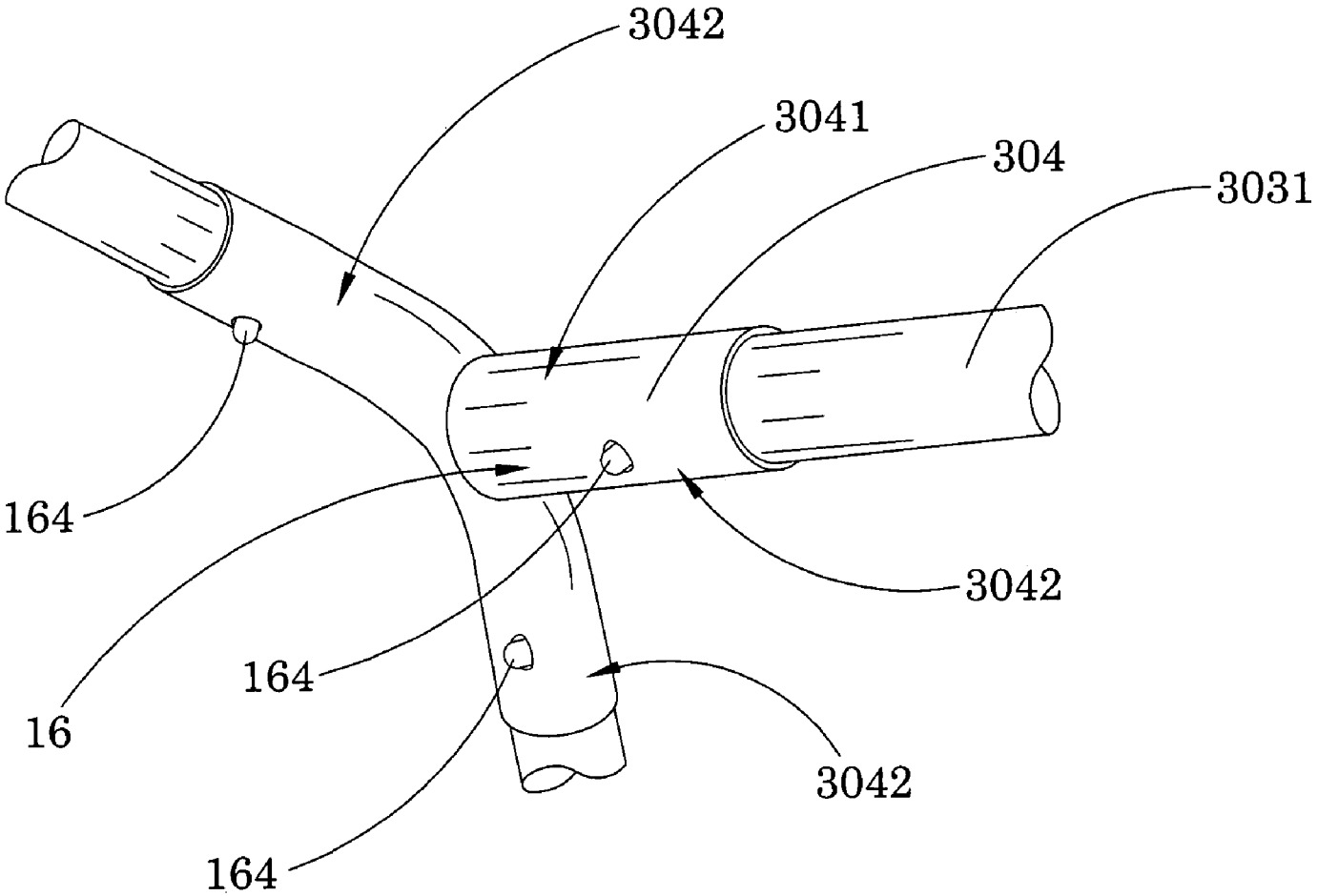
FIG. 10A and FIG. 10B are schematic diagrams of the detachable connector of the outdoor canopy according to the above preferred embodiment of the present invention.

Referring to 8 and FIG. 10A of the drawings, the roof frame 3 further comprises a plurality of connectors 304 connecting each reinforcing members 3031 with the corresponding adjacent reinforcing members 3031, the legs frame 6, and/or with the corresponding shelter supporting member 302. More specifically, each of the connectors 304 has a tubular cross section, and has a main connector portion 3041 and a plurality of mounting portions 3042 extended from the main connector portion 3041 for connecting with the corresponding reinforcing members 3031 and/or the shelter supporting member 302. Accordingly, each of the connectors 304 may be embodied as the above-mentioned three-way connector or the four-way connector, in which an upper portion of each of the self-adjustable supporting legs 61 is arranged to be mounted at the corresponding connector 304 for erecting the roof frame 3 above the legs frame 6, and standing on an uneven ground.

The canopy shelter 20 comprises a roof shelter 26 attached on the roof frame 3 for substantially shading the canopy area from the top of the outdoor canopy to define the ceiling wall 21 of the canopy shelter 20, and a body shelter 27 encirclingly attached around the legs frame 3 to define the front wall 22, the rear wall 23, and the two sidewalls 24 as a front panel, a rear panel, and two side panels of the body shelter 27, wherein the front entrance 25 is formed on the front wall 22 for allowing a desire object, such as a vehicle, passing through the front entrance 25. As mentioned earlier, both the roof shelter 26 and the body shelter 27 are made of waterproof materials for ensuring substantial protection of the canopy area from adverse weather conditions.

The ventilation arrangement 30 preferably comprises four side windows 14 formed at the two sidewalls 24 of the canopy shelter 20 for allowing air circulating between the canopy area and an exterior thereof. Accordingly, each of the side windows 14 further contains a window opening 143 formed on a predetermined position of the sidewalls 24 of the canopy shelter 20, wherein the window screen 141 is mounted at the corresponding window opening 143 for blocking unwanted objects, such as dirt and insects, from entering into the canopy area through the corresponding side window 14.

The ventilation arrangement 30 further comprises a plurality of ventilating skylights 31 formed at the ceiling wall 21 of the canopy fabric 20 for allowing air circulating within the canopy area, wherein each of the ventilating skylights 31 has a skylight opening 311 for forming a roof window at the ceiling wall 21, and comprises a fabric made skylight panel 312 extended from the ceiling wall 21 to foldably cover at the roof window such that when the skylight panel 312 is upwardly lifted to expose the roof window, the skylight panel 312 is adapted for allowing the air ventilating from the canopy area through the roof window and for preventing dust and rain from entering into the canopy area.

Figure 9:
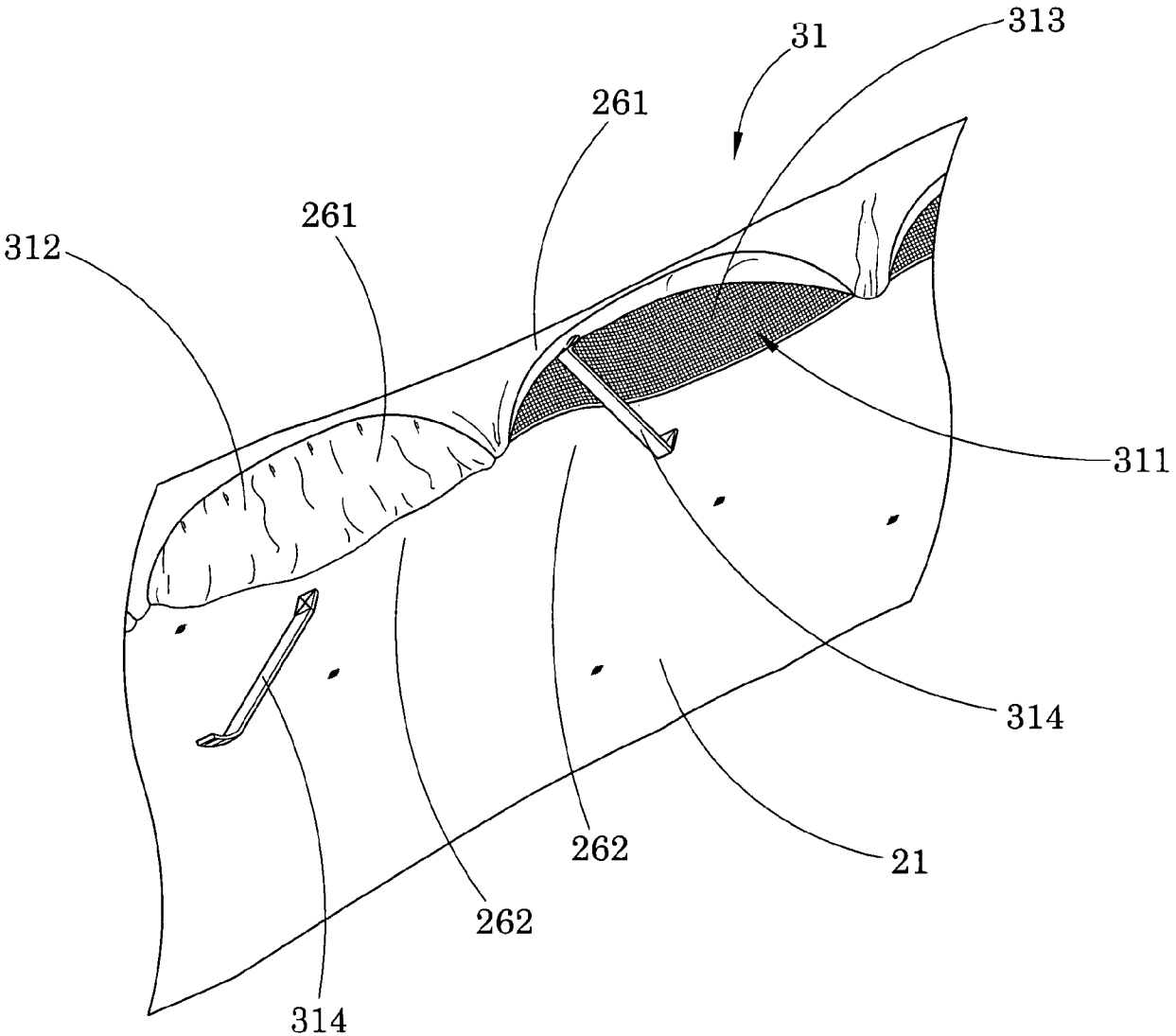
FIG. 9 is a schematic diagram of the ventilating skylight of the outdoor canopy according to the above preferred embodiment of the present invention.

Referring to FIG. 9 of the drawings, according the preferred embodiment of the present invention, the roof shelter 26 comprises a first and a second roof fabric panel 261, 262 attached on the roof frame 3, wherein the first roof fabric panel 261 is attached on the roof supporting member 301 and downwardly extended therefrom to partially and overlappedly cover the second roof fabric panel 262 as forming the skylight panel 312, wherein the second roof fabric panel 262 is detachably attached on the shelter supporting members 302 of the roof frame 3. Thus, it is worth mentioning that for each of the ventilating skylight 31, the skylight opening 311 is formed as the opening between the first and the second roof fabric panel 261, 262 for communicating the canopy area with an exterior thereof.

Moreover, each of the ventilating skylights 31 further comprises a skylight screen 313 provided at the skylight opening 311 on the roof shelter 26 for normally allowing air passing through the skylight opening 311 while blocking unwanted objects, such as dirt or insects, from entering into the canopy area through the skylight opening 311. It is worth mentioning that each of the skylight screens 313 is preferably embodied as a mesh having a plurality of elongated fabric elements extended at the corresponding skylight opening 311 in a cross manner for forming a net structure of the skylight screen 313.

In order to ensure that the ventilating skylights 31 have sound ventilation effect, each of the ventilating skylights 31 further comprises an elongated retention member 314 flexibly attached on the second roof fabric panel 262 and arranged to detachably attached on the first roof fabric panel 261, preferably via a Velcro, for preventing the first roof fabric panel 261 from overlapping on the second roof fabric panel 262 so as to prevent the skylight opening 311 from being blocked by the first and the second roof fabric panel 261, 262. In other words, the retention member 314 is arranged to ensure adequate exposure of the canopy area to an exterior of the outdoor canopy so as to ensure effective ventilation of the canopy area (i.e. prevent the ventilating skylights 31 from collapsing).

Figure 11:
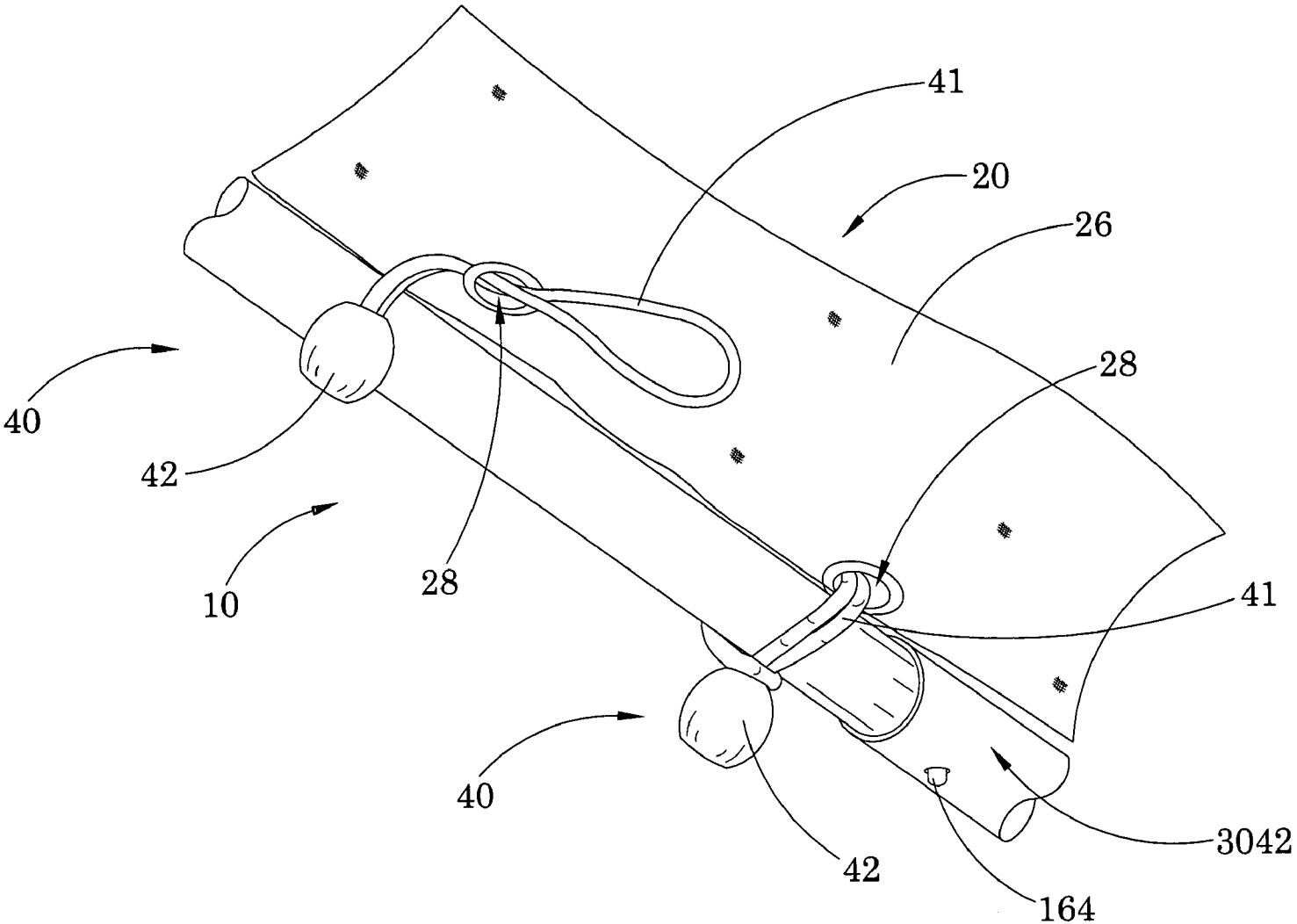
FIG. 11 is a schematic diagram of the detachable fastening arrangements according to the above preferred embodiment of the present invention.

In order to mount the canopy shelter 20 onto the canopy frame 10, the outdoor canopy of the present invention further comprises a plurality of detachable fastening arrangements 40 detachably connecting the canopy shelter 20 with the canopy frame 10 so as to detachably mount the canopy shelter 20 onto the canopy frame 10 and thereby facilitate easy assembling and disassembling of the present invention. More specifically, referring to FIG. 11 of the drawings, each of the detachable fastening arrangements 40 comprises a resilient fastening member 41 integrally formed as an endless fastening loop, and a locking member 42 operatively mounted on the resilient fastening member 41 in such a manner that when the fastening member 41 has fastened the canopy shelter 20 to the canopy frame 10, the locking member 42 is utilized to ensure secure fastening of the resilient fastening member 41. Thus, the canopy shelter 20 further has a plurality of fastening holes 28 formed on the roof shelter 26 and/or the body shelter 27 wherein the corresponding detachable fastening arrangement 40 is adapted to pass through the fastening hole 28, and to fasten on the canopy frame 10 so as to detachably attach the canopy shelter 20 to the canopy frame 10.

Figure 12:
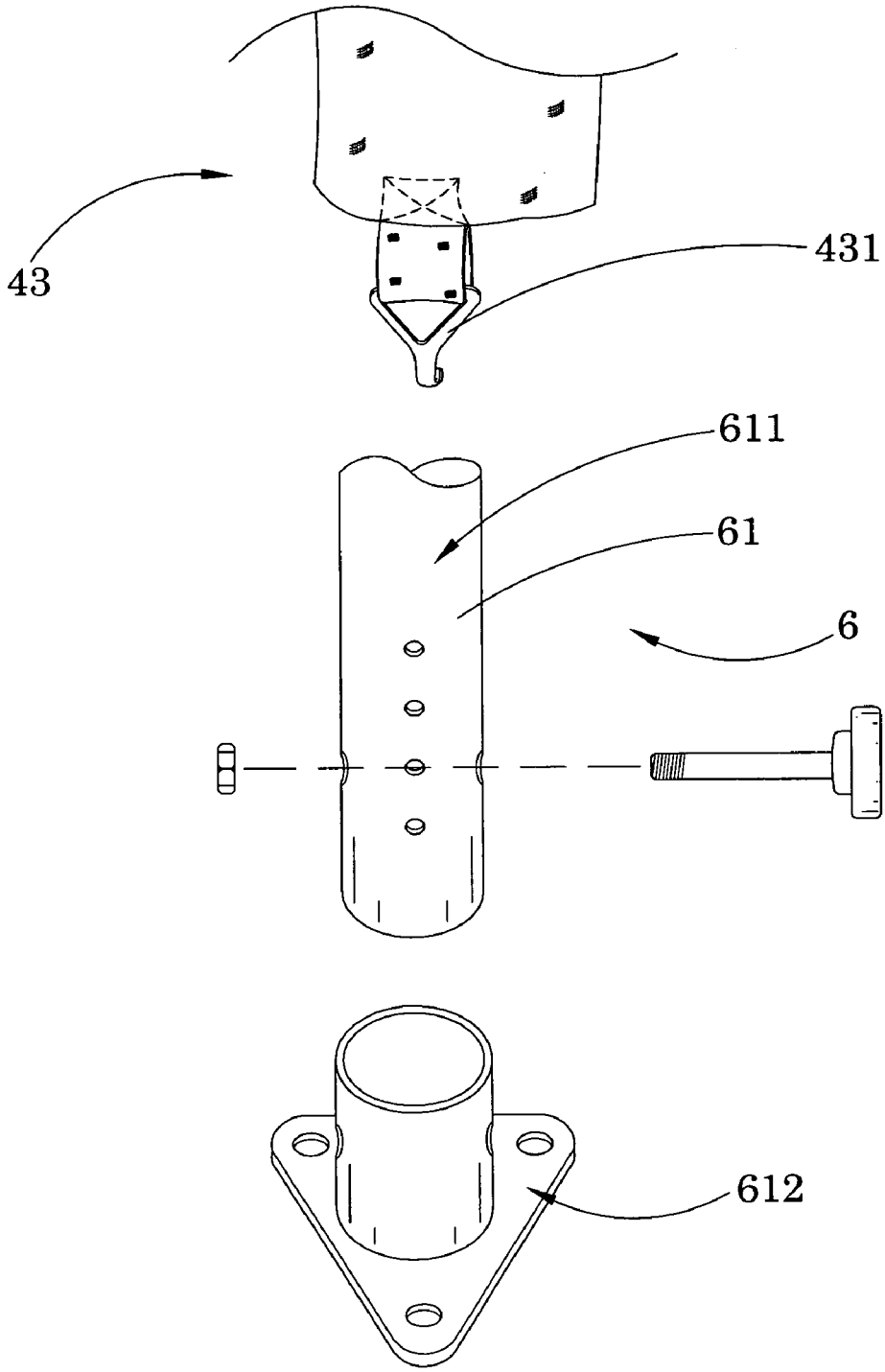
FIG. 12 is a schematic diagram of a supporting leg according to the above preferred embodiment of the present invention.

In order to further enhance the security of which the roof shelter 26 is fastened onto the canopy frame 10, referring to FIG. 8 and FIG. 12 of the drawings, the detachable fastening arrangement 40 further comprises a plurality of elongated adjustable fasteners 43, each having a fastening hook 431 formed at a bottom edge portion of the respective elongated adjustable fasteners 43, extended from four corner portions of the second roof fabric panel 262 of the roof shelter 26 for adjustably coupling with the corresponding supporting legs 61 of the canopy frame 10 so as to further enhance a security to which the roof shelter 26 is detachably fastened onto the canopy frame 10.

Figure 10B:
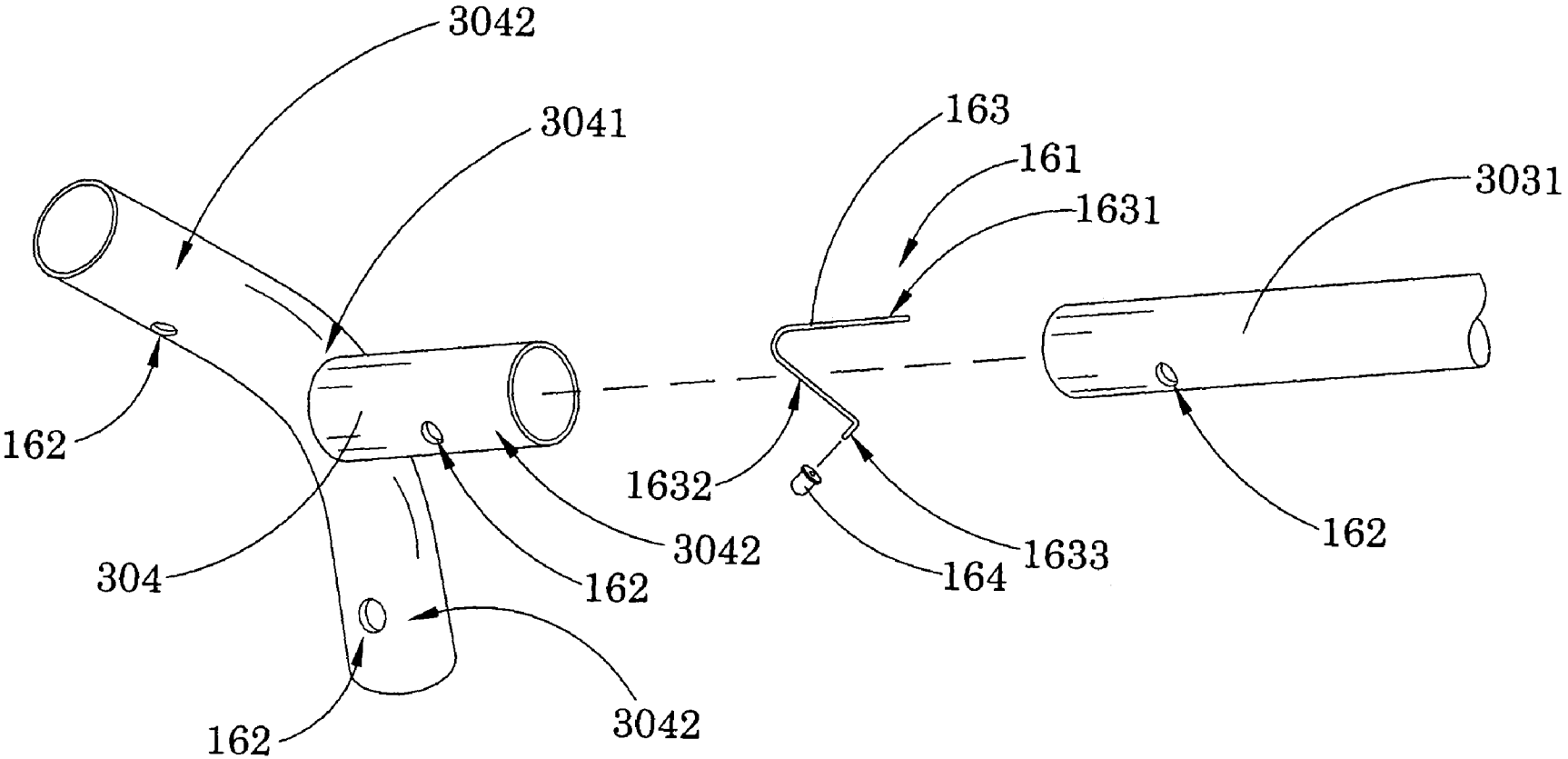

Referring to FIG. 10A and FIG. 10B of the drawings, the canopy frame 10 of the outdoor canopy further comprises a resilient mounting arrangement 16 provided thereon for detachably mounting the reinforcing members 3031 of the roof reinforcing frame 303 with the connectors 304 (i.e. the three-way connectors or the four-way connectors). The resilient mounting arrangement 16 comprises a plurality of detachable mounting devices 161 provided on the canopy frame 10, wherein each of the detachable mounting devices 161 comprises a plurality of mounting holes 162 formed on the reinforcing members 3031 and the mounting portions 3042 of the connectors 304, a resilient element 163 received in the corresponding reinforcing member 3031 for aligning with the corresponding mounting holes 162, and an actuator 164 mounted at the corresponding mounting hole 162 to operatively connect with the corresponding resilient element 163. It is worth mentioning that each of the resilient elements 163 has a first resilient portion 1631 and a second resilient portions 1632 integrally extended from the first resilient portion 1631 at a predetermined inclination to form a substantially resilient V-shape cross section of the resilient element 163 for normally exerting an outward pushing force towards the sidewall of the respective reinforcing member 3031. The resilient element 163 further has a locker end 1633 transversely extended from the second resilient portion 1632 to pass through the corresponding mounting hole 162 formed on the respective reinforcing member 3031, wherein the actuator 164 is connected with the locker end 1633 at the mounting hole 161, in such a manner that the actuator 164 is normally protruded out of the reinforcing member 3031, and is adapted to be pushed back into the reinforcing member 3031 from an exterior thereof.

The operation of the resilient mounting arrangement 16 is as follows: the detachable mounting device 161 is first mounted within a reinforcing member 3031 with the actuator 164 protruding from the corresponding mounting hole 161. Suppose that this reinforcing member 3031 is to be detachably connected with one of the mounting portions 3042 of one of the connectors 304. It is essential that a diameter of the mounting portion 3042 is slightly larger than a diameter of that corresponding reinforcing member 3031. When the actuator 164 is pressed into the reinforcing member 3031, a corresponding end portion of the reinforcing member 3031 is adapted to be inserted into the mounting portion 3042 of the connector 304. When the corresponding mounting holes 162 of the connector 304 and the reinforcing member 3031 coincide, the actuator 164 will be pressed outwardly by the resilient element 163 to pass through the two mounting holes 162 and constitute as a blockage for locking up a further longitudinal movement of the reinforcing member 3031. When it is desired that the reinforcing member 3031 to be detached from the connector 304, the user needs only to inwardly press the actuator 164 so as to clear the blockage thereof. Ultimately, the reinforcing member 3031 is free to be detached from the connector 304 by sliding out therefrom.

Referring to FIG. 12 of the drawings, each of the supporting legs 61 comprises a main leg body 611 and a leg supporting base 612 mounted underneath a bottom portion of the corresponding main leg body 611 for adjusting a height of the supporting leg 61 with respective to a ground surface, especially an uneven ground surface. Specifically, each of the supporting legs 61 has a plurality of adjustment holes 613 spacedly formed on the main leg body 611 and the leg supporting base 612, wherein leg supporting base 612 is mounted to the main leg body 611 at predetermined adjustment holes 613 so as to adjust an overall height of the respective supporting leg 61. As a result, the height of the supporting legs 61 is adjustable for securely standing on an uneven ground surface. According to the preferred embodiment of the present invention, each of the fastening hooks 431 is adapted to couple with the corresponding adjustment hole 613 of the leg frame 6 for further tightening up the roof shelter 26 to the canopy frame 10 in a tension manner.

Figure 13:
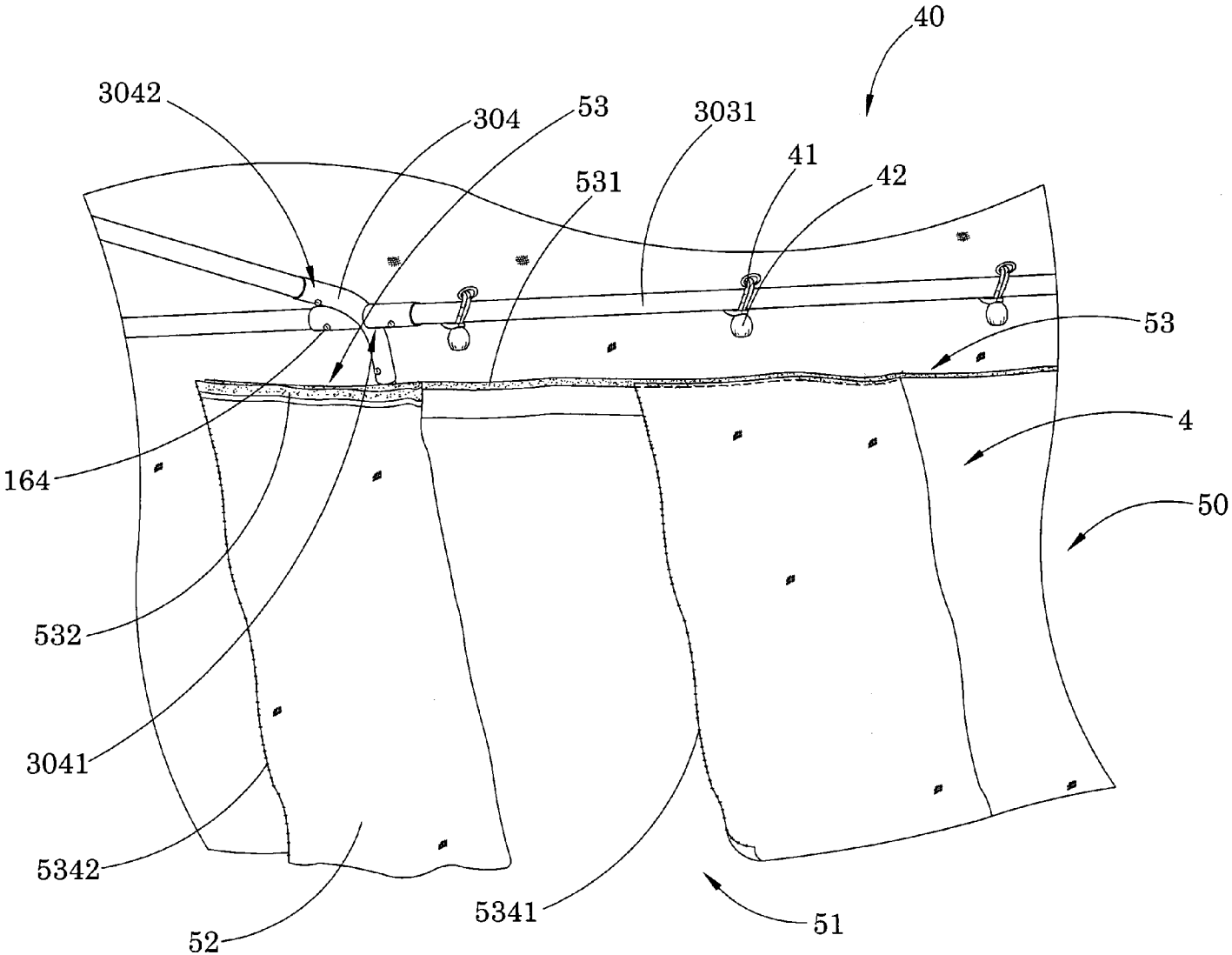
FIG. 13 is a schematic view of a side entrance of the outdoor canopy according to the above preferred embodiment of the present invention.

Referring to FIG. 7, FIG. 8 and FIG. 13 of the drawings, the outdoor canopy further comprises a side entrance arrangement 50 formed on at least one of the sidewalls 24 of the canopy shelter 20 for a user to pass gain entry to and exit the canopy area through the side entrance arrangement 50. According to the preferred embodiment of the present invention, the side entrance arrangement 50 contains a side entrance opening 51 formed on one of the sidewalls 24 of the canopy shelter 20, and comprise two entrance fabric panels 52 operatively mounted on the corresponding sidewalls 24 of the canopy shelter 20 in such a manner that the side entrance arrangement 50 is adapted to operate between an opened position and a closed position, wherein in the opened position, the entrance fabric panels 52 are folded and securely held in the vicinity of the side entrance opening 51 for exposing the canopy area to an exterior thereof, wherein in the closed position, the entrance fabric panels 52 are released to cover the side entrance opening 51 so as to form the above mentioned side door 4 of the canopy shelter 20. It is worth mentioning that with the help of the side entrance arrangement 50, a user is able to exit the canopy area through the side entrance opening 51. Thus when the user has park his or her vehicle in the canopy area, he or she is able to leave the outdoor canopy directly through the side entrance opening 51 without going to the front entrance 25.

In other words, the side entrance arrangement 50 is for a driver accessing the canopy area without having to pass through the front entrance 25, wherein the side entrance arrangement 50 contains a first side entrance opening 51 formed on the first sidewall of the canopy shelter 20 for aligning with a vehicle door of the vehicle, and comprises at least a fabric made first side door as one of the entrance fabric panels 52 foldably mounted on the first sidewall 24 to selectively enclose the first side entrance opening 51 such that the side entrance arrangement 50 is adapted to fold between the opened position and the closed position, wherein at the opened position, the first side door is folded to expose the first side entrance opening 51 for the driver accessing the canopy area, and at the closed position, the first side door covers the first side entrance opening 51 to form a side entrance of the canopy shelter.

Moreover, where the canopy is adapted to shelter two vehicles, the side entrance arrangement 50 further contains a second side entrance opening 51 formed on the second sidewall 24 of the canopy shelter 20 for aligning with another vehicle door of the vehicle, and comprises at least a fabric made second side door as another of the entrance fabric panels 52 foldably mounted on the second sidewall 24 to selectively enclose the second side entrance opening 51 such that when the second side door 54 is folded to exposed the second side entrance opening 51, the second side entrance opening 51 forms another side entrance for a passenger accessing the canopy area without having to pass through the front entrance 25.

Accordingly, the side entrance arrangement 50 further comprises two fabric retention arrangements 53 provided in the vicinity of the side entrance openings 51 respectively for retaining the respective entrance fabric panels 52 at either the opened position or the closed position. More specifically, each of the fabric retention arrangements 53 comprises a hook fastener 531 and a plurality of loop fasteners 532 attached on a top side edge of the side entrance opening 51, and the corresponding side edges of each of the entrance fabric panels 52 respectively, wherein when the entrance fabric panels 52 are at the closed position, the loop fastener 532 formed on an outer top side edge of each of the entrance fabric panels 52 is attached on the hook fastener 531 while the entrance fabric panels 52 are unfolded to block the side entrance opening 51 so as to close it. When the entrance fabric panels 52 are at the opened position, the entrance fabric panels 52 are sidewardly folded in such a manner that the loop fasteners 532 formed on an inner top side edge of each of the entrance fabric panels 52 is attached on the hook fastener 531 so as to retain the entrance fabric panels 52 at the opened position for exposing the canopy area to an exterior thereof. Thus, the user of the present invention is able to exit the canopy area through the opened side entrance opening 51.

In order to further conceal the canopy area when the entrance fabric panels 52 are at the closed position, the fabric retention arrangement 53 further comprises two side entrance zippers 534 having a first and a second zipper elements 5341, 5342 attached on two inner side edges of the corresponding entrance fabric panels 52 respectively in such a manner that when the entrance fabric panels 52 are at the closed position, the first and the second zipper elements 5341, 5342 are adapted to be detachably zipped together for closing the side entrance opening 51.

In other words, each of the side entrance zippers 534 is transversely formed at each of the first and second side doors to define two door panels at each of the first and second side doors 54 as the entrance fabric panels 52 respectively, wherein each of the side entrance zippers 534 has the first and second zipper elements 5341, 5342 which are attached to two inner side edges of the two door panels respectively and are detachably fastened with each other to enclose the respective first and second side entrance openings 51.

Figure 14:
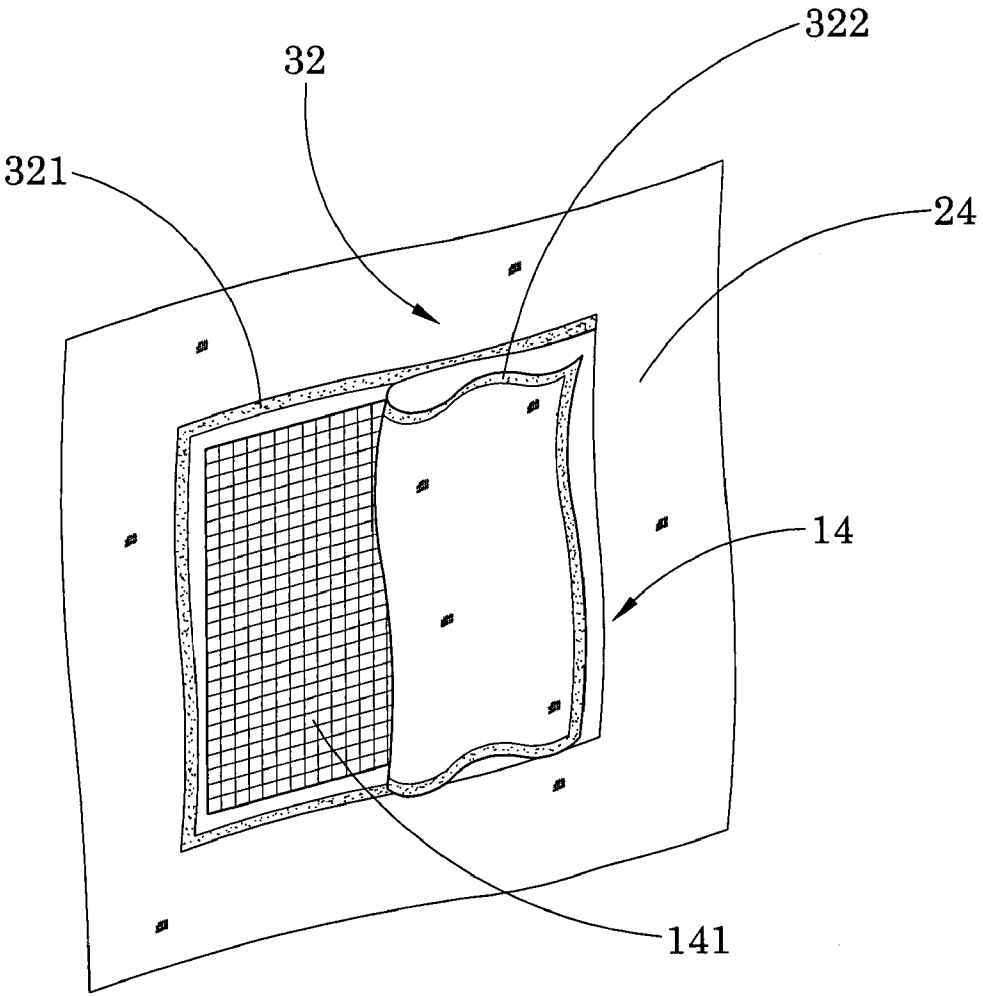
FIG. 14 is a schematic view of the side window retention arrangement according to the above preferred embodiment of the present invention.

Referring to FIG. 14 of the drawings, the ventilation arrangement 30 further comprises a side window retention arrangement 32 formed at the side window 14 for retaining the window blind 142 as folded to expose the window screen 141 and the canopy area to an exterior thereof. Thus, the side window retention arrangement 32 comprises a plurality of hook fasteners 321 formed at least one (preferably all) of the four inner and outer side edges of the window screen 141, and a plurality of loop fasteners 322 formed the corresponding inner side edges of the window blind 142 and the outer side edges of the window blind 142, wherein the hook fasteners 321 are arranged to normally detachably attached with the corresponding loop fasteners 322 so as to close the side window 14, and in such a manner that when the window blind 142 is folded to expose the window screen 141, the window blind 142 is arranged to be sidewardly or upwardly flipped along the hook fastener 321 formed at the top side edge of the window screen 141 so as to open the side window 14.

Figure 15:
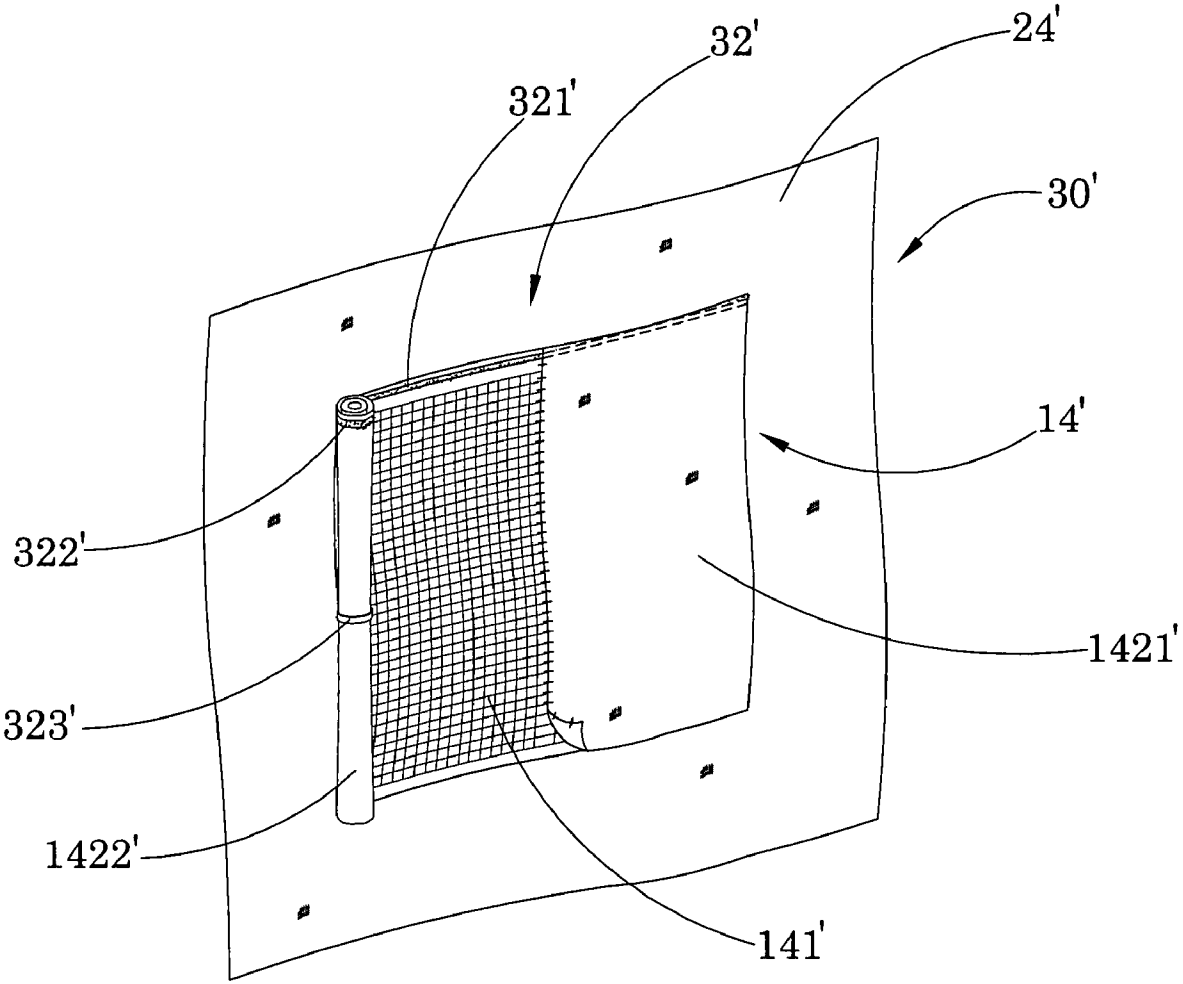
FIG. 15 is a first alternative mode of the outdoor canopy according to the above preferred embodiment of the present invention.

Referring to FIG. 15 of the drawings, a first alternative mode of the outdoor canopy according to the preferred embodiment of the present invention is illustrated. The first alternative mode is similar to the preferred embodiment, except the ventilation arrangement 30' and the side entrance arrangement 50'. According to the first alternative mode, the window blind 142' of each of the side windows 14' comprises two blind members 1421', 1422', wherein the loop fasteners 322' are attached on the side edges of the blind members 1421', 1422' respectively in such a manner that when the window blind 142' is folded to expose the window screen 141', each of the blind members 1421', 1422' is arranged to be sidewardly rolled along the hook fastener 321' formed at the top side edge of the window screen 141'. Thus, the window tightening members 323' are adapted for tightening up the blind members 1421' 1422' when they have been sidewardly rolled to expose the window screen 141'. A zipper may be provided between the inner side edges of each of the blind members 1421', 1422' so that when the window blind 142' is closed to cover the window screen 141', the zipper may connect the two blind members 1421', 1422' for completely covering the window screen 141'.

Figure 16A:
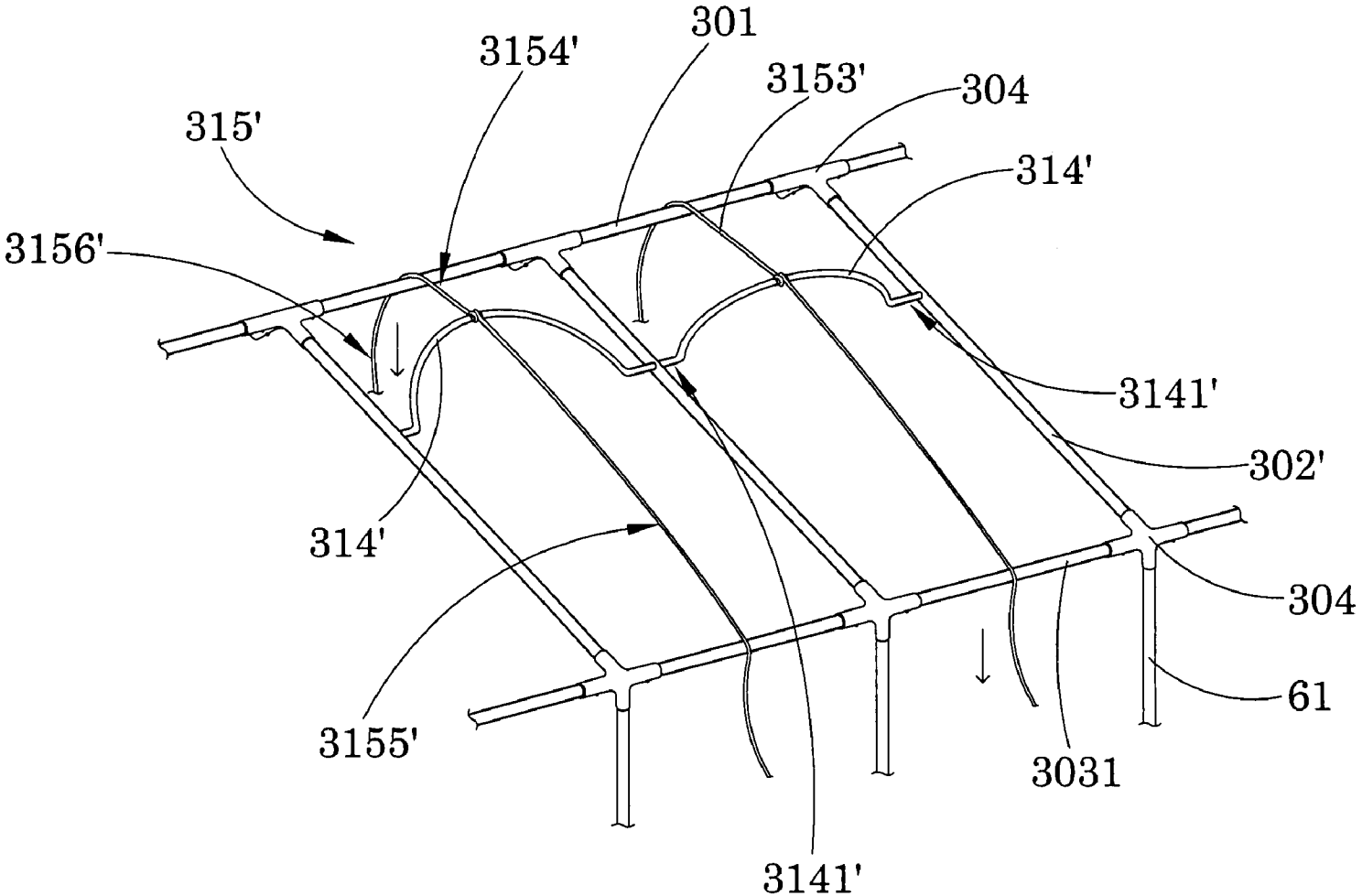
FIG. 16A and FIG. 16B are schematic diagrams of the ventilating arrangement according to the first alternative mode of the outdoor canopy.
Figure 16B:
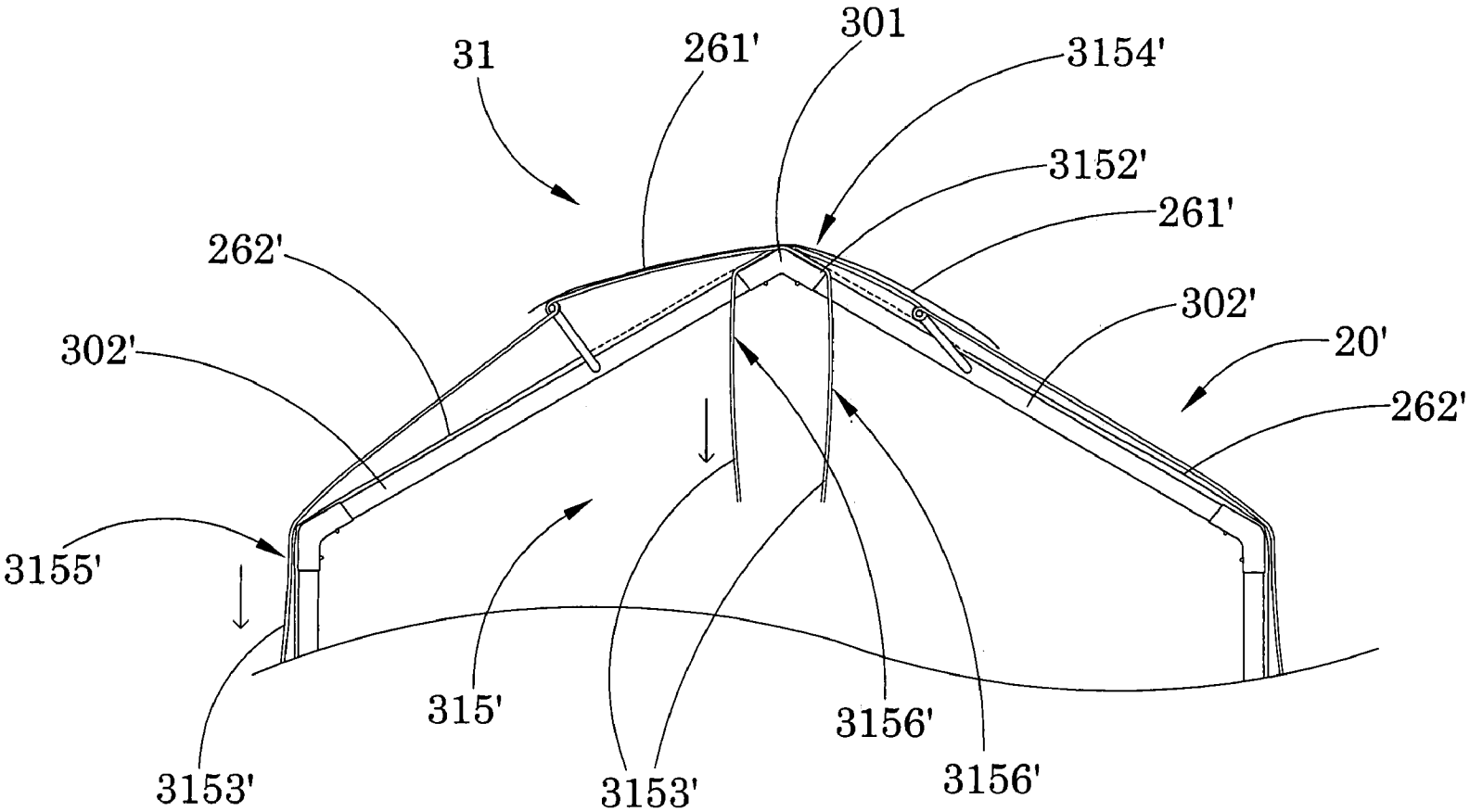

Moreover, referring to FIG. 16A and FIG. 16B of the drawings, each of the retention member 314' of the of the ventilating skylights 31' is embodied as a retention wire which is bent to form a semi-circular cross section, wherein the retention member 314' is provided onto the second roof fabric panel 262' at the inner side edge of the corresponding skylight opening 311' for selectively opening the corresponding ventilating skylight 31'. More specifically, each of the retention members 314' has two pivot end portions 3141' and a central curved portion extending between the two pivot end portions 3141', wherein the two pivot end portions 3141' are pivotally connected with the shelter supporting member 302' in such a manner that when the retention member 314' is driven to rotate, the central curved portion thereof is arranged to move the first roof fabric panel 261' away from the second roof fabric panel 262' so as to open the corresponding ventilating skylight 31' for ventilation.

Each of the ventilating skylights 31' further comprises a skylight controller 315' attached to the retention member 314' for controlling an operation thereof so as to selectively open and close the corresponding ventilating skylight 31'. More specifically, the skylight controller 315' comprises a pivot supporter 3152' mounted at the roof shelter 26, and an actuating wire 3153', wherein the actuating wire 3153' has a pivot guiding portion 3154' slidably engage with the pivot supporter 3152', a skylight opening portion 3155' downwardly extended from an inner end of the pivot guiding portion 3152' within the canopy area, and a skylight closing portion 3156' extended from an outer end of the pivot guiding portion 3154' to an outside of the canopy shelter 20', in such a manner that when the skylight opening portion 3155' is pulled by a user of the present invention, the retention member 314' is outwardly and pivotally moved to drive the first roof fabric panel 261' moving away from the second roof fabric panel 262' so as to open the ventilating skylight 31', and when the skylight closing portion 3156' is pulled by the user from within the canopy area, the retention member 314' is pivotally and inwardly move to allow overlapping of the second roof fabric panel 262' by the first roof fabric panel 261' so as to close the ventilating skylight 31'. Thus, a user is able to conveniently open and close the ventilating skylight 31' according to the circumstances in which the outdoor canopy of the present invention is utilized.

Figure 17:
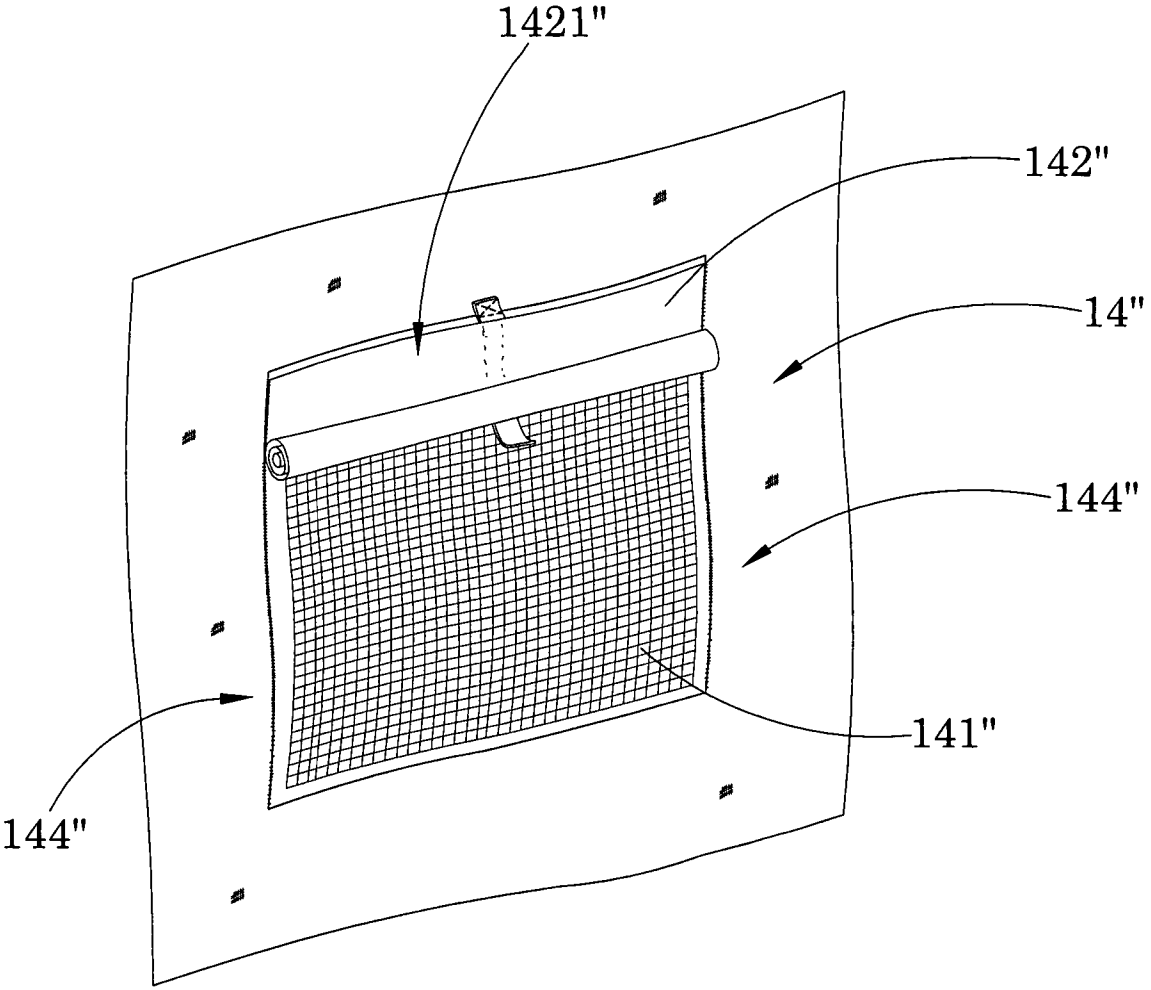
FIG. 17 is a second alternative mode of the outdoor canopy according to the above preferred embodiment of the present invention.
Figure 18:
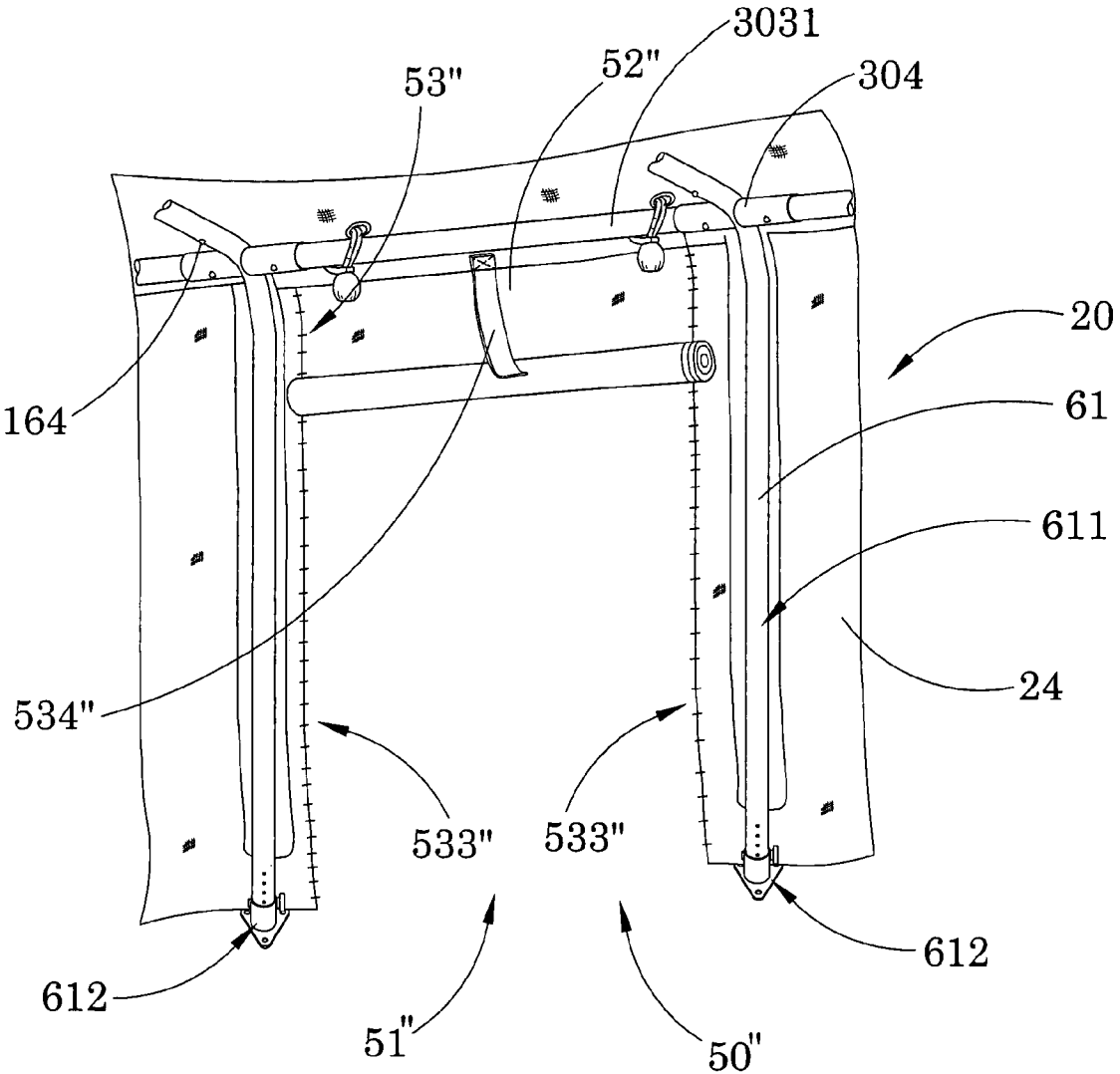
FIG. 18 is a second alternative mode of the outdoor canopy according to the above preferred embodiment of the present invention, illustrating that an alternative mode of the side entrance arrangement.

Referring to FIG. 17 to FIG. 18 of the drawings, a second alternative mode of the outdoor canopy according to the preferred embodiment of the present invention is illustrated. The second alternative mode is similar to the preferred embodiment except the ventilating arrangement 30" and the side entrance arrangement 50". According to the second alternative mode, each of the side window has a plurality of zippers 144" spacedly provided on the window blind 142" to form a main blind portion 1421' of the window blind 142", wherein when the zippers 144" are both opened, the main blind portion 1421" of the window blind 142" is arranged to be rolled up for exposing the window screen 141" to an exterior of the canopy area. Conversely, the zippers 144" are closed, the main blind portion 1421" is allowed to be released for substantially shading the window screen 141" so as to close side window 14".

Referring to FIG. 18 of the drawings, the side entrance arrangement 50" contains an entrance opening 51", an entrance fabric panels 52", and a fabric retention arrangement 53". The fabric retention arrangement 53" comprises a plurality of side entrance zipper 533" formed on two side edge portions of the entrance fabric panels 52" to form a main fabric portion 521" of the entrance fabric panels 52", wherein when the side entrance zippers 533" are both opened, the main fabric portion 521" is arranged to be rolled up for exposing the side entrance 51" to an exterior of the canopy area. Conversely, when the side entrance zippers 53" are closed, the main fabric portion 521" is allowed to be released for substantially shading the side entrance 51" so as to block access to the canopy area via the side entrance 51".

It is worth mentioning that the fabric retention arrangement 53" further comprises a plurality of string fasteners 534" fastening the entrance fabric panels 52" when the main fabric portion 521" is rolled up for exposing canopy area. Thus, the main fabric portion 521" is accordingly retained at the upper portion of the side entrance 51".

Figure 19:
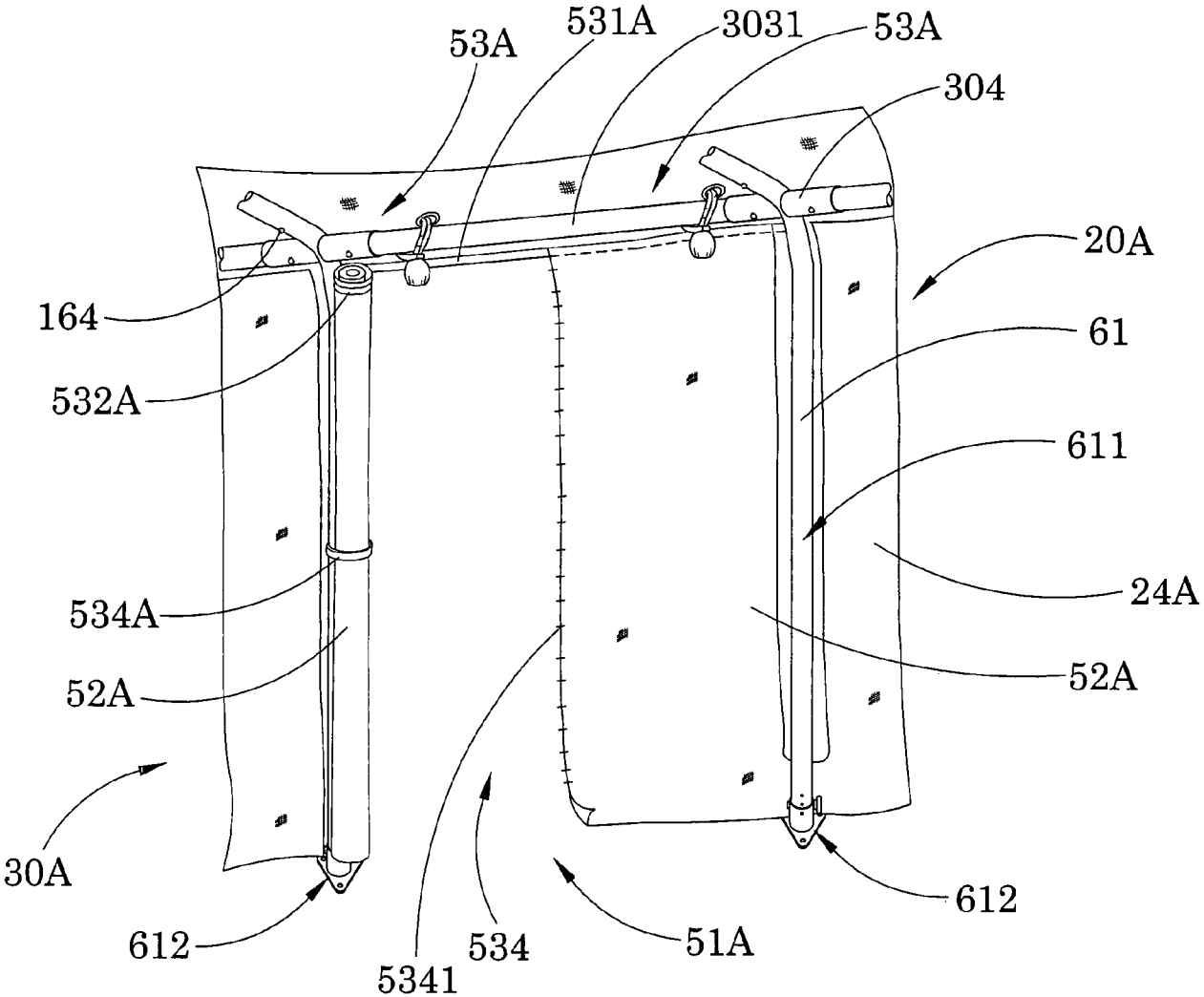
FIG. 19 is a third alternative mode of the outdoor canopy according to the above preferred embodiment of the present invention.

Referring to FIG. 19, a third alternative mode of the outdoor canopy according to the preferred embodiment of the present invention is illustrated. The third alternative mode is similar to the preferred embodiment except the side entrance arrangement 50A. According to the third alternative mode, the side entrance arrangement 50A is also formed on at least one of the sidewalls 24A of the canopy shelter 20A for a user to pass gain entry to and exit the canopy area through the side entrance arrangement 50A. The side entrance arrangement 50A contains a side entrance opening 51A formed on one of the sidewalls 24A of the canopy shelter 20A, and comprise two entrance fabric panels 52A operatively mounted on the corresponding sidewalls 24A of the canopy shelter 20A in such a manner that the side entrance arrangement 50A is adapted to operate between an opened position and a closed position, wherein in the opened position, the entrance fabric panels 52A are rolled and securely held in the vicinity of the side entrance opening 51A for exposing the canopy area to an exterior thereof, wherein in the closed position, the entrance fabric panels 52A are released to cover the side entrance opening 51A so as to form the above mentioned side door 4 of the canopy shelter 20A.

Moreover, the side entrance arrangement 50A further comprises two fabric retention arrangements 53A provided in the vicinity of the side entrance openings 51 respectively for retaining the respective entrance fabric panels 52A at either the opened position or the closed position. More specifically, each of the fabric retention arrangements 53A comprises a hook fastener 531A and a plurality of loop fasteners 532A attached on a top side edge of the side entrance opening 51A, and the corresponding side edges of each of the entrance fabric panels 52A respectively, wherein when the entrance fabric panels 52A are at the closed position, the loop fastener 532A formed on an outer top side edge of each of the entrance fabric panels 52A is attached on the hook fastener 531A while the entrance fabric panels 52A are unfolded to block the side entrance opening 51A so as to close it. When the entrance fabric panels 52A are at the opened position, the entrance fabric panels 52A are sidewardly rolled in such a manner that the loop fasteners 532A formed on an inner top side edge of each of the entrance fabric panels 52A is attached on the hook fastener 531A so as to retain the entrance fabric panels 52A at the opened position for exposing the canopy area to an exterior thereof. Thus, the user of the present invention is able to exit the canopy area through the opened side entrance opening 51A.

In order to further conceal the canopy area when the entrance fabric panels 52A are at the closed position, the fabric retention arrangement 53A still comprises the side entrance zippers 534 having a first and a second zipper elements 5341, 5342 attached on two inner side edges of the corresponding entrance fabric panels 52A respectively in such a manner that when the entrance fabric panels 52A are at the closed position, the first and the second zipper elements 5341, 5342 are adapted to be detachably zipped together for closing the side entrance opening 51A.

The fabric retention arrangement 53A can further comprises a plurality of string fasteners 534A fastening the entrance fabric panels 52A" when it is rolled up for exposing canopy area.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor canopy for a vehicle, comprising:

a canopy frame which comprises a roof frame and a legs frame downwardly extended from said roof frame to form a canopy area within said roof frame and said legs frame for said vehicle parking within said canopy area, wherein said roof frame comprises a plurality of tubular supporting members and a plurality of connectors detachably connecting said supporting members end-to-end to form a roof supporting frame, a roof boundary frame for said leg frame downwardly extending therefrom, and a shelter supporting frame downward and inclinedly extended from said roof supporting frame to said roof boundary frame;

a canopy shelter, which is made of waterproof fabric, detachably fastening at said canopy frame and defining a ceiling wall, a front wall, a rear wall, and first and second sidewalls to enclose said canopy area therewithin for sheltering said vehicle, wherein said canopy shelter has a front entrance formed at said front wall for said vehicle entering into said canopy area, wherein said canopy frame further comprises a resilient mounting arrangement comprising a plurality of detachable mounting devices provided on said canopy frame, wherein each of the detachable mounting devices contains a plurality of mounting holes formed on each of said supporting members and said connectors, and comprises a V-shaped resilient element having at least a locking end arranged when said supporting member is connected to said connector to align said mounting hole at said supporting member with said mounting hole at said connector, said resilient element is disposed in said supporting member at a position that said locking end of said resilient element passes through said mounting holes of said supporting member and said connector to lock up said supporting member with said connector;

a side entrance arrangement for a driver accessing said canopy area without having to pass through said front entrance, wherein said side entrance arrangement contains a first and second side entrance opening formed on said first and said second sidewall of said canopy shelter respectively for aligning with at least a vehicle door of said vehicle, and comprises, a plurality of hook fasteners, a plurality of loop fasteners, at least a fabric made first side door, a fabric made second side door, and a side entrance zipper, wherein said first side door is foldably mounted on said first sidewall to selectively enclose said first side entrance opening such that said side entrance arrangement is adapted to fold between an opened position and a closed position, wherein at said opened position, said first side door is folded to expose said first side entrance opening for said driver accessing said canopy area, and at said closed position, said first side door covers said first side entrance opening to form a side entrance of said canopy shelter, wherein said second side entrance opening is arranged to align with another vehicle door of said vehicle, wherein said fabric made second side door is foldably mounted on said second sidewall to selectively enclose said second side entrance opening such that when said second side door is folded to expose said second side entrance opening, said second side entrance opening forms another side entrance for a passenger accessing said canopy area without having to pass through said front entrance, wherein said hook fasteners are provided at surrounding edges of said first and second side entrance openings respectively, and said loop fasteners are provided at peripheral edges of said first and second side doors to detachably fasten with said hook fasteners respectively so as to selectively expose one of said first and second side entrance openings, wherein said side entrance zipper is transversely formed at each of said first and second side doors with respective to said corresponding side door to define two door panels at each of said first and second side doors, wherein each of said side entrance zippers has first and second zipper elements which are attached to two inner side edges of said two door panels respectively and are detachably fastened with each other to enclose said respective first and second side entrance openings;

at least a side window, wherein said side window comprises a window screen formed at one of said sidewalls of said canopy shelter and a window blind overlappingly mounted on said respective sidewall in a foldable manner to selectively enclose said window screen, such that said window blind is folded to enclose said window screen for preventing dust and rain entering into said canopy area and is folded to expose said window screen for enhancing an air ventilation of said canopy shelter and for allowing said canopy area being seen through said window screen; and a plurality of ventilating skylights formed at said ceiling wall of said canopy shelter for enhancing air circulation within said canopy area, wherein each of said ventilating skylights has a skylight opening forming a roof window at said ceiling wall and comprises a fabric made skylight panel extended from said ceiling wall to foldably cover said roof window such that when said skylight panel is upwardly lifted to expose said roof window, said skylight panel is adapted for allowing air ventilating from said canopy area through said roof window and for preventing dust and rain from entering into said canopy area, wherein each of said ventilating skylights comprises a roof shelter comprising a first roof fabric panel as said skylight panel, and a second roof fabric panel attached on said roof frame, wherein said first roof fabric panel is attached on said roof shelter and downwardly extended therefrom to partially and overlappedly cover said second roof fabric panel, wherein said skylight opening is formed as an opening between said first and said second roof fabric panels for communicating said canopy area with an exterior thereof via said skylight opening.

2. The outdoor canopy, as recited in claim 1, wherein each of said ventilating skylights further comprises a skylight screen provided at said skylight opening for allowing air passing through said skylight opening while blocking unwanted objects from entering into said canopy area through said skylight opening and an elongated retention member flexibly attached on said second roof fabric panel, and arranged to detachably attach on said first roof fabric panel for preventing said first roof fabric from overlapping on said second roof fabric so as to prevent said skylight opening from collapsing.

3. The outdoor canopy, as recited in claim 2, further comprising a plurality of detachable fastening arrangements, wherein each of said detachable fastening arrangement contains a fastening hole formed on said roof shelter and comprises a resilient fastening member passing through said fastening hole to form a fastening loop to tighten at said roof frame so as to detachably attach said canopy shelter to said canopy frame in a tension manner.

4. The outdoor canopy, as recited in claim 3, wherein said legs frame comprises a plurality of length-adjustable supporting legs spacedly and downwardly extended from said roof frame to self-adjust a height of said roof frame with respect to an uneven ground surface and a plurality of adjustable fasteners fastening to said supporting legs, wherein each of said supporting legs has a plurality of adjustment holes spacedly formed thereon, wherein each of said adjustable fasteners, having a hooking end, extended from said roof shelter to detachably fasten said roof shelter on said roof frame at a position that said hooking end of each of said adjustable fasteners is selectively engaged with one of said adjustment holes at said respective supporting leg so as to retain said roof shelter on said roof frame in a tension manner.

5. The outdoor canopy, as recited in claim 1, further comprising a plurality of detachable fastening arrangements, wherein each of said detachable fastening arrangement contains a fastening hole formed on said roof shelter and comprises a resilient fastening member passing through said fastening hole to form a fastening loop to tighten at said roof frame so as to detachably attach said canopy shelter to said canopy frame in a tension manner.

6. The outdoor canopy, as recited in claim 5, wherein said legs frame comprises a plurality of length-adjustable supporting legs spacedly and downwardly extended from said roof frame to self-adjust a height of said roof frame with respect to an uneven ground surface and a plurality of adjustable fasteners fastening to said supporting legs, wherein each of said supporting legs has a plurality of adjustment holes spacedly formed thereon, wherein each of said adjustable fasteners, having a hooking end, extended from said roof shelter to detachably fasten said roof shelter on said roof frame at a position that said hooking end of each of said adjustable fasteners is selectively engaged with one of said adjustment holes at said respective supporting leg so as to retain said roof shelter on said roof frame in a tension manner.

* * * * *